US012504210B2

(12) United States Patent
Hjortland et al.

(10) Patent No.: US 12,504,210 B2
(45) Date of Patent: Dec. 23, 2025

(54) ENERGY EFFICIENT HEAT PUMP WITH CONTROL SYSTEM AND COMPRESSOR INJECTION

(71) Applicant: Johnson Controls Tyco IP Holdings LLP, Milwaukee, WI (US)

(72) Inventors: Andrew Leroy Hjortland, Stoughton, WI (US); Jeremy Ryan Smith, Park City, KS (US); Andrew Michael Boyd, Wichita, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/539,082

(22) Filed: Dec. 13, 2023

(65) Prior Publication Data

US 2024/0200839 A1 Jun. 20, 2024

Related U.S. Application Data

(60) Provisional application No. 63/432,660, filed on Dec. 14, 2022.

(51) Int. Cl.
*F25B 41/31* (2021.01)
*F25B 13/00* (2006.01)

(52) U.S. Cl.
CPC ..... *F25B 41/31* (2021.01); *F25B 13/00* (2013.01); *F25B 2400/13* (2013.01); *F25B 2600/2513* (2013.01)

(58) Field of Classification Search
CPC ..... F25B 41/31; F25B 13/00; F25B 2400/13; F25B 2600/2513
See application file for complete search history.

(56) References Cited

U.S. PATENT DOCUMENTS

2009/0293515 A1 12/2009 Lifson et al.
2014/0305150 A1 10/2014 Kim et al.
(Continued)

FOREIGN PATENT DOCUMENTS

EP 3901539 A1 10/2021
JP H08121917 A * 5/1996
(Continued)

OTHER PUBLICATIONS

Saito et al., Air Conditioner, Oct. 11, 2017, JP2007263440A, Whole Document (Year: 2007).*
(Continued)

*Primary Examiner* — Larry L Furdge
(74) *Attorney, Agent, or Firm* — Fletcher Yoder, PC

(57) ABSTRACT

An energy efficient heat pump includes a working fluid circuit configured to circulate a working fluid, where the working fluid circuit includes a compressor, a first heat exchanger, a second heat exchanger, a first expansion device, an economizer, and a reversing valve, where the reversing valve is configured to adjust a flow direction of the working fluid through the working fluid circuit. The heat pump further includes an injection conduit extending from a first conduit of the working fluid circuit to an injection port of the compressor, where the injection conduit includes a second expansion device, and the injection conduit is configured to direct a portion of the working fluid from the working fluid circuit, through the second expansion device, through the economizer, and to the injection port of the compressor to inject of the portion of the working fluid into the compressor.

18 Claims, 15 Drawing Sheets

(56) References Cited

U.S. PATENT DOCUMENTS

| | | | | |
|---|---|---|---|---|
| 2015/0233622 | A1* | 8/2015 | Yajima | F25B 49/005 62/129 |
| 2017/0336120 | A1* | 11/2017 | Kawano | F25B 13/00 |
| 2019/0331367 | A1* | 10/2019 | Hern | G05D 23/1931 |
| 2020/0200441 | A1* | 6/2020 | Nagamatsu | F25B 41/39 |

FOREIGN PATENT DOCUMENTS

| | | | | |
|---|---|---|---|---|
| JP | H0989389 | A | * | 4/1997 |
| JP | 2002061922 | A | * | 2/2002 |
| JP | 2010133605 | A | | 6/2010 |
| JP | 2014142168 | A | * | 8/2014 |
| JP | 2017026238 | A | * | 2/2017 |
| JP | 2007263440 | A | * | 10/2017 |
| KR | 100623515 | B1 | | 9/2006 |

OTHER PUBLICATIONS

Hibino et al., Refrigerant Quantity Determining Device, May 17, 1996, JPH08121917A, Whole Document (Year: 1996).*

Suzuki et al., Refrigerating Cycle Apparatus, Apr. 4, 1997, JPH0989389A, Whole Document (Year: 1997).*

Uchiumi, Method for Controlling Air Conditioner, Feb. 28, 2002, JP2002061922A, Whole Document (Year: 2002).*

Toyoda et al., Freezer, Aug. 7, 2014, JP2014142168A, Whole Document (Year: 2014).*

Noguchi et al., Heat Pump Cycle Device, Feb. 2, 2017, JP2017026238A, Whole Document (Year: 2017).*

International Search Report and Written Opinion for PCT Application No. PCT/US2023/084121, mailed Apr. 25, 2024, 10 pages.

* cited by examiner

ENERGY EFFICIENT HEAT PUMP WITH CONTROL SYSTEM AND COMPRESSOR INJECTION

CROSS-REFERENCE TO RELATED APPLICATIONS

This application claims priority from and the benefit of U.S. Provisional Patent Application No. 63/432,660, entitled "HEAT PUMP CONTROL SYSTEMS AND METHODS," filed Dec. 14, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Embodiments of the present disclosure are directed to heating, ventilation, and/or air conditioning (HVAC) systems configured to operate with reduced energy consumption and reduced greenhouse gas emissions. More particularly, embodiments of the present disclosure are directed to energy efficient heat pumps, including reverse cycle heat pumps and air-source heat pumps, having a control system configured to operate the energy efficient heat pump in cold climate conditions with by utilizing intermediate fluid injection in a compressor, which improves efficiency, reduces energy consumption, and reduces generation of greenhouse gas emissions.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which transfer thermal energy between the HVAC system and the environment. Typically, a compressor is fluidly coupled to a refrigerant circuit of the vapor compression system and is configured to circulate a working fluid (e.g., refrigerant) between the condenser and the evaporator. In this way, the compressor facilitates heat exchange between the refrigerant, the condenser, and the evaporator. In some cases, the HVAC system may be a heat pump configured to enable reversal of refrigerant flow through the refrigerant circuit. As such, the heat pump enables the condenser to operate as an evaporator (e.g., a heat absorber) and the evaporator to operate as a condenser (e.g., a heat rejector). Accordingly, the HVAC system may operate in multiple operating modes (e.g., a cooling mode, a heating mode) to provide both heating and cooling to the building with one refrigerant circuit. Unfortunately, conventional heat pump systems may operate with reduced efficiency in certain conditions.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, an energy efficient heat pump for a heating, ventilation, and air conditioning (HVAC) system includes a working fluid circuit and a first conduit of the working fluid circuit, where the first conduit extends between a first heat exchanger and a second heat exchanger of the working fluid circuit, and the first conduit includes a first expansion device and a second expansion device. The energy efficient heat pump also includes a compressor disposed along the working fluid circuit, where the compressor is configured to direct a working fluid along the working fluid circuit, and the compressor includes a suction port and an injection port, and an injection conduit extending from the first conduit to the injection port of the compressor, where the injection conduit includes a third expansion device, and the injection conduit is configured to direct a portion of the working fluid from the working fluid circuit, through the third expansion device, and to the injection port of the compressor to inject of the portion of the working fluid into the compressor. The energy efficient heat pump further includes a controller communicatively coupled to the first expansion device, the second expansion device, and the third expansion device, where the controller is configured to control the first expansion device, the second expansion device, and the third expansion device based on an operating mode of the energy efficient heat pump, an operating parameter of the compressor, or both.

In another embodiment, an energy efficient heat pump includes a working fluid circuit configured to circulate a working fluid, where the working fluid circuit includes a compressor, a first heat exchanger, a second heat exchanger, a first expansion device, an economizer, and a reversing valve, where the reversing valve is configured to adjust a flow direction of the working fluid through the working fluid circuit. The energy efficient heat pump also includes a first conduit of the working fluid circuit, where the first conduit extends between the first heat exchanger and the second heat exchanger, the economizer is disposed along the first conduit, and the first conduit is configured to direct the working fluid between the first heat exchanger and the second heat exchanger and through the economizer. The energy efficient heat pump further includes an injection conduit extending from the first conduit to an injection port of the compressor, where the injection conduit includes a second expansion device, and the injection conduit is configured to direct a portion of the working fluid from the working fluid circuit, through the second expansion device, through the economizer, and to the injection port of the compressor to inject of the portion of the working fluid into the compressor.

In a further embodiment, an energy efficient heat pump includes a working fluid circuit configured to circulate a working fluid, where the working fluid circuit includes a compressor, a first heat exchanger, a second heat exchanger, a first expansion device, a second expansion device, an economizer, and a reversing valve, and where the reversing valve is configured to adjust a flow direction of the working fluid through the working fluid circuit. The energy efficient heat pump also includes a first conduit of the working fluid circuit, where the first conduit extends between the first heat exchanger and the second heat exchanger, the economizer is disposed along the first conduit, and the first conduit is configured to direct the working fluid between the first heat exchanger and the second heat exchanger and through the economizer. The energy efficient heat pump further includes an injection conduit extending from the first conduit to an injection port of the compressor, where the injection conduit includes a third expansion device, and the economizer is disposed along the injection conduit, and the energy efficient heat pump includes a controller configured to control the first expansion device, the second expansion device, and the third expansion device based on an operating mode of the energy efficient heat pump, a pressure ratio of the compressor, and a speed of the compressor.

BRIEF DESCRIPTION OF THE DRAWINGS

Various aspects of this disclosure may be better understood upon reading the following detailed description and upon reference to the drawings in which.

DETAILED DESCRIPTION

Figure 1:
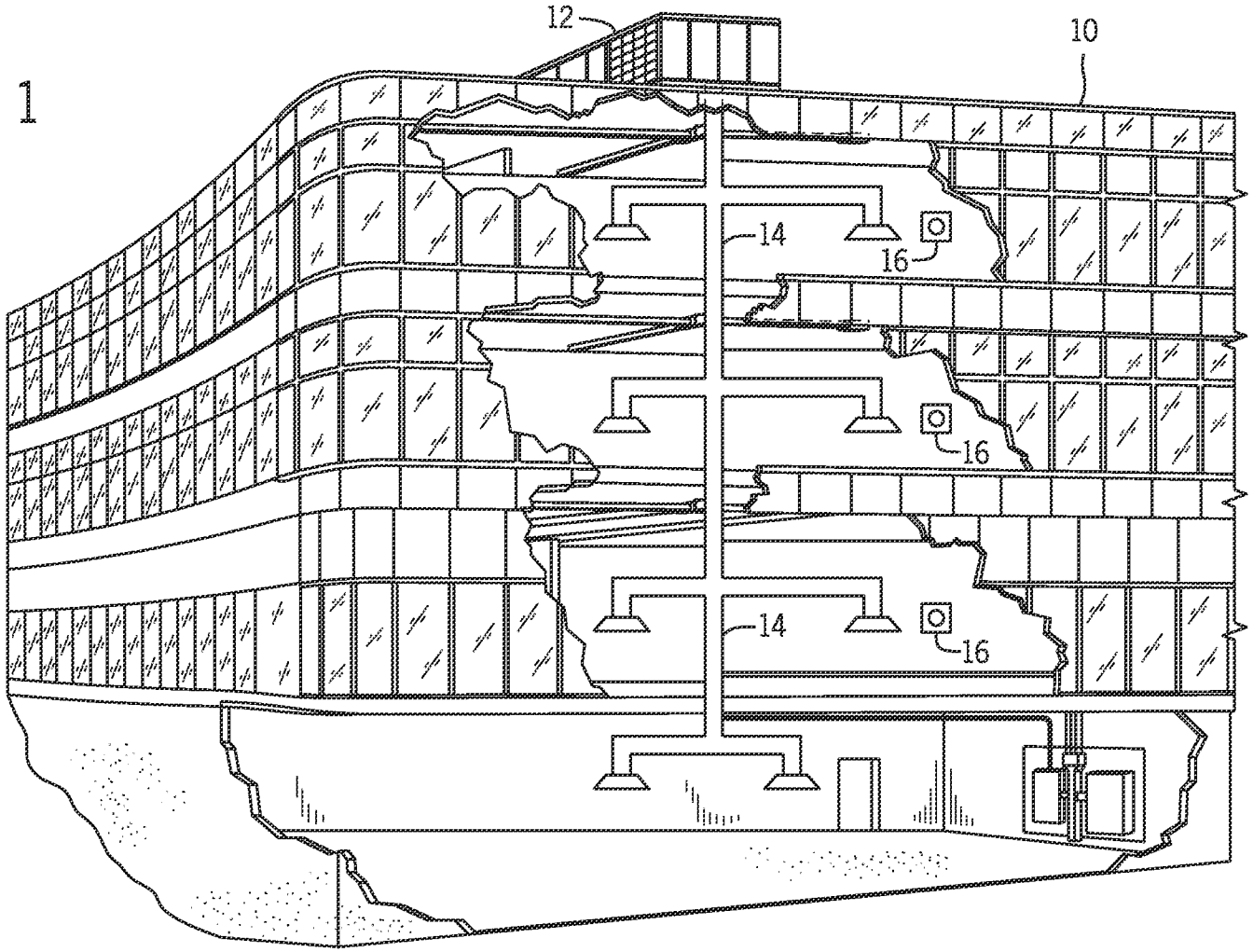
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit. A compressor may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow). Additionally or alternatively, the HVAC system may include a heat pump (e.g., a heat pump system) having a first heat exchanger (e.g., a heating and/or cooling coil, an indoor coil, the evaporator) positioned within the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load and the ambient environment, for example.

The heat pump system is operable to provide both cooling and heating to the space to be conditioned (e.g., a room, zone, or other region within a building) by adjusting a flow of the working fluid through the working fluid circuit. Thus, the heat pump system may not include a dedicated heating system, such as a furnace or burner configured to combust a fuel, to enable operation of the HVAC system in the heating mode. As a result, the heat pump is configured to operate with reduced greenhouse gas emissions. For example, during operation of the heat pump system in a cooling mode, the compressor may direct working fluid through the working fluid circuit and the first and second heat exchangers in a first flow direction. While receiving working fluid in the first flow direction, the first heat exchanger (which may be positioned within the space to be conditioned) may operate as an evaporator and, thus, enable working fluid flowing through the first heat exchanger to absorb thermal energy from an air flow directed to the space. Further, the second heat exchanger (which may be positioned in the ambient environment surrounding the heat pump system), may operate as a condenser to reject the heat absorbed by the working fluid flowing from the first heat exchanger (e.g., to an ambient air flow directed across the second heat exchanger). In this way, the heat pump system may facilitate cooling of the space or other thermal load serviced by (e.g., in thermal communication with) the first heat exchanger.

Conversely, during operation in a heating mode, a reversing valve (e.g., a switch-over valve) enables the compressor to direct working fluid through the working fluid circuit and the first and second heat exchangers in a second flow direction, opposite the first flow direction. While receiving working fluid in the second flow direction, the first heat exchanger may operate as a condenser instead of an evaporator, and the second heat exchanger may operate as an evaporator instead of a condenser. As such, the first heat exchanger may receive (e.g., from the second heat exchanger) a flow of heated working fluid to reject heat to thermal load serviced by the first heat exchanger (e.g., an air flow directed to the space) and, thus, facilitate heating of the thermal load. In this way, the heat pump system may facilitate either heating or cooling of the thermal load based on the current operational mode of the heat pump system (e.g., based on a flow direction of working fluid along the working fluid circuit).

Unfortunately, heat pumps may be susceptible to operational efficiencies in certain conditions or circumstances. For example, in many cases, certain heat pumps may be ill-suited and/or inefficient for certain HVAC system applications or conditions (e.g., based on amounts of heating and cooling typically desired in a particular HVAC system application). For example, a heating load of a heat pump may be greater in a cold climate than in a warm climate, but a cooling load of the heat pump in the same cold climate may be lower. In such applications, the heat pump may include a compressor that operates inadequately or inefficiently in a heating mode to satisfy a greater heating demand in the cold climate, but the compressor may operate adequately in a cooling mode. Alternatively, some heat pumps utilized in a cold climate may operate adequately in the heating mode but may operate inefficiently in the cooling mode.

Conventional approaches to address such shortcomings with heat pumps are typically expensive and complicated. Conventional approaches may also be associated with increased energy consumption and generation of greenhouse gas emissions. For example, heat pumps may be implemented with auxiliary heating systems, such as electric heating systems or fuel combustion heating systems, which add costs to the manufacture, maintenance, and operation of the HVAC system. Moreover, utilization of auxiliary heating systems, such as furnaces, generally results in the undesirable generation of greenhouse gas emissions. Indeed, conventional HVAC systems utilizing heat pumps, particularly in cold climate environments, are inefficient and/or expensive. For at least the foregoing reasons, conventional HVAC systems utilizing heat pumps, particularly in cold climate environments, are inefficient, expensive, and/or susceptible to increased emissions. It is presently recognized that improved heat pump systems that mitigate or substantially eliminate the aforementioned shortcomings of conventional HVAC systems are desired.

Accordingly, embodiments of the present disclosure relate to a heat pump system that is configured to enable more efficient operation (e.g., in cold climate environments) and/or to enable reduction in costs associated with manufacturing, operating, and maintaining an HVAC system, and enable a reduction in the generation of greenhouse gas emissions. For example, present embodiments include heat pump systems configured to operate in cold climate environments to satisfy heating demands without utilization of an auxiliary heating system, such as a furnace. In this way, the present techniques enable a reduction in energy consumption and a reduction in greenhouse gas emissions. As discussed in detail below, the heat pump system (e.g., a reverse-cycle heat pump system, an air-source heat pump system) may include a compressor having an injection port configured to receive a flow of vapor and/or liquid at an intermediate portion of the compressor (e.g., between a suction port and a discharge port of the compressor). In other words, the compressor is configured to receive a flow of working fluid (e.g., refrigerant) from the working fluid circuit (e.g., from a heat exchanger) of the heat pump system, and the compressor is also configured to receive a flow of vapor and/or liquid working fluid via the injection ports.

In accordance with present techniques, the flow of vapor and/or liquid working fluid directed to the injection ports of the compressor may be directed from another portion of the working fluid circuit. As discussed above, the working fluid circuit may be configured to direct a flow of working fluid from the first heat exchanger to the second heat exchanger in one operating mode (e.g., cooling) and from the second heat exchanger to the first heat exchanger in another operating mode (e.g., heating). A portion of the flow of working fluid (e.g., liquid working fluid) may be directed from the working fluid circuit at a location between the first and second heat exchangers (e.g., a liquid line location) to a compressor injection conduit extending from the location to the injection port of the compressor. An expansion device (e.g., electronic expansion valve) and/or a subcooler (e.g., an economizer) may be disposed along the compressor injection conduit and may expand or "flash" the portion of the flow of working fluid to produce a vapor working fluid or a vapor and liquid mixture of working fluid. The portion of the flow of working fluid may then be injected into the compressor for compression with working fluid received by the compressor via the suction port of the compressor. By injecting working fluid into the compressor, various improvements and benefits may be provided. For example, the injected flow of working fluid may provide cooling to the compressor, which may enable more efficient operation of the compressor (e.g., reduced energy consumption). Additionally, by injecting working fluid into the compressor and combining the injected working fluid with working fluid received via the suction port of the compressor, a mass flow rate of working fluid discharged by the compressor may be increased, which may increase an operating capacity of the particular heat exchanger that receives the discharged working fluid from the compressor in a particular operating mode of the heat pump system.

Embodiments of the present disclosure also include an improved control system configured to regulate operation of the heat pump system. In addition to the expansion device disposed along the compressor injection conduit discussed above, the heat pump may also include one or more expansion devices disposed along the working fluid circuit (e.g., between the first and second heat exchangers). In accordance with present techniques, the control system may regulate operation of the expansion devices of the heat pump system to enable more efficient operation of the heat pump system (e.g., reduced energy consumption). For example, the control system may control operation of the expansion devices of the heat pump system based on an operating mode of the heat pump system, based on operating conditions or parameters of the heat pump system, and/or additional variables. In this way, present embodiments enable more efficient operation of the heat pump system in both heating and cooling modes, as well as across a wider range of operating conditions (e.g., in colder climates) and/or operating capacities. Indeed, the present embodiments provide energy efficient heat pumps configured to operate and satisfy heating demands in cold climate conditions with reduced energy consumption and without operation of a furnace or other heating system configured to combust or consume a fuel, thereby enabling a reduction of greenhouse gas emissions.

It should be understood that one or more of the compressors included in the heat pump system may be multi-stage (e.g., two stage) compressors and/or variable speed compressors. Additionally, the present techniques may be incorporated with heat pump systems utilizing different types of compressors, such as rotary compressors, scroll compressors, high-side shell compressors, and so forth. These and other features will be described below with reference to the drawings.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
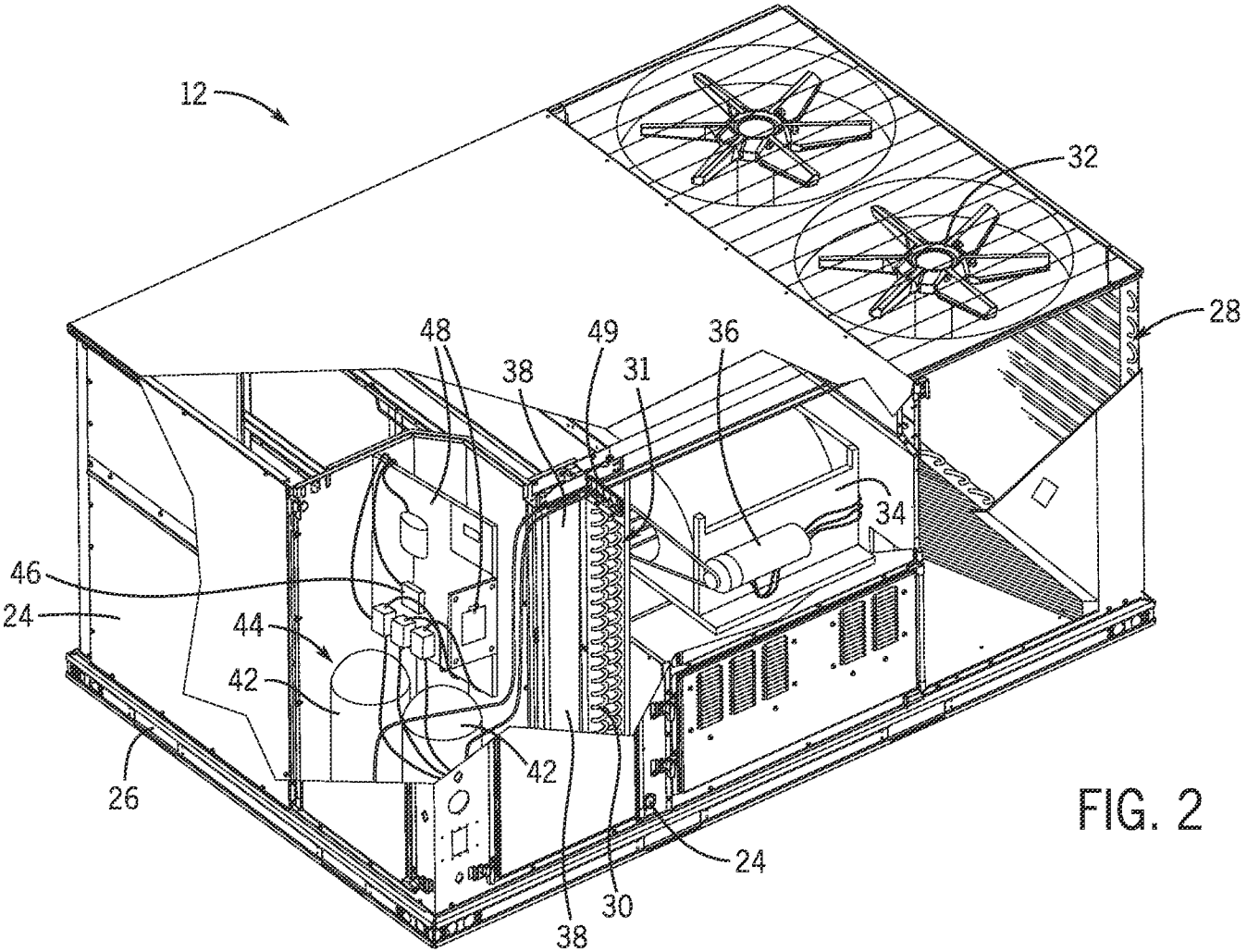
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent vapor compression circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more vapor compression circuits. Tubes within the heat exchangers 28 and 30 may circulate a working fluid (e.g., a refrigerant), such as R-410A, R-407, R-134a, R-1234ze, R1233zd, R-32, hydrofluoro olefin (HFO), "natural" refrigerants like ammonia (NH3), R-717, carbon dioxide (CO2), R-744, or hydrocarbon based refrigerants, water vapor, or any other suitable working fluid through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
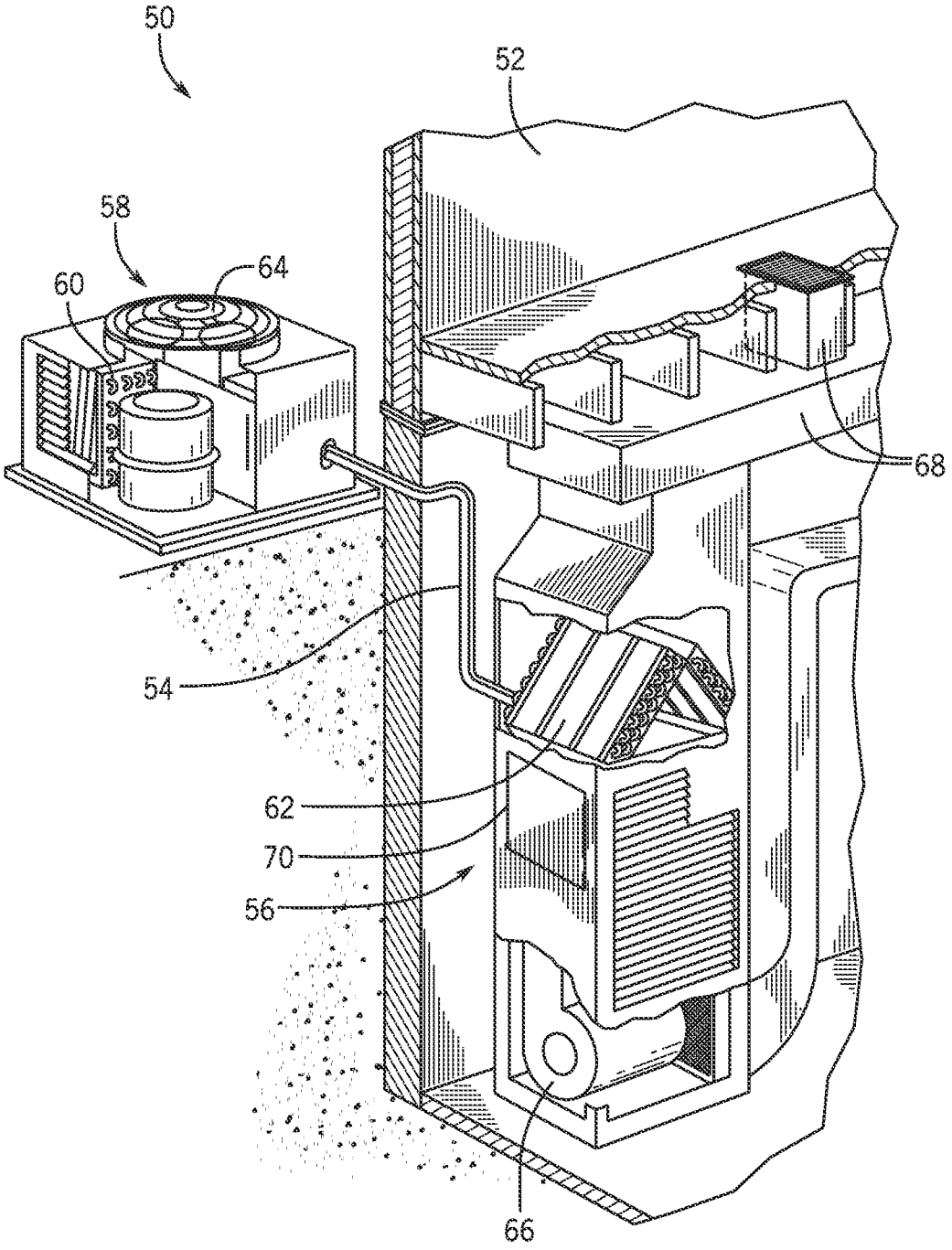
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
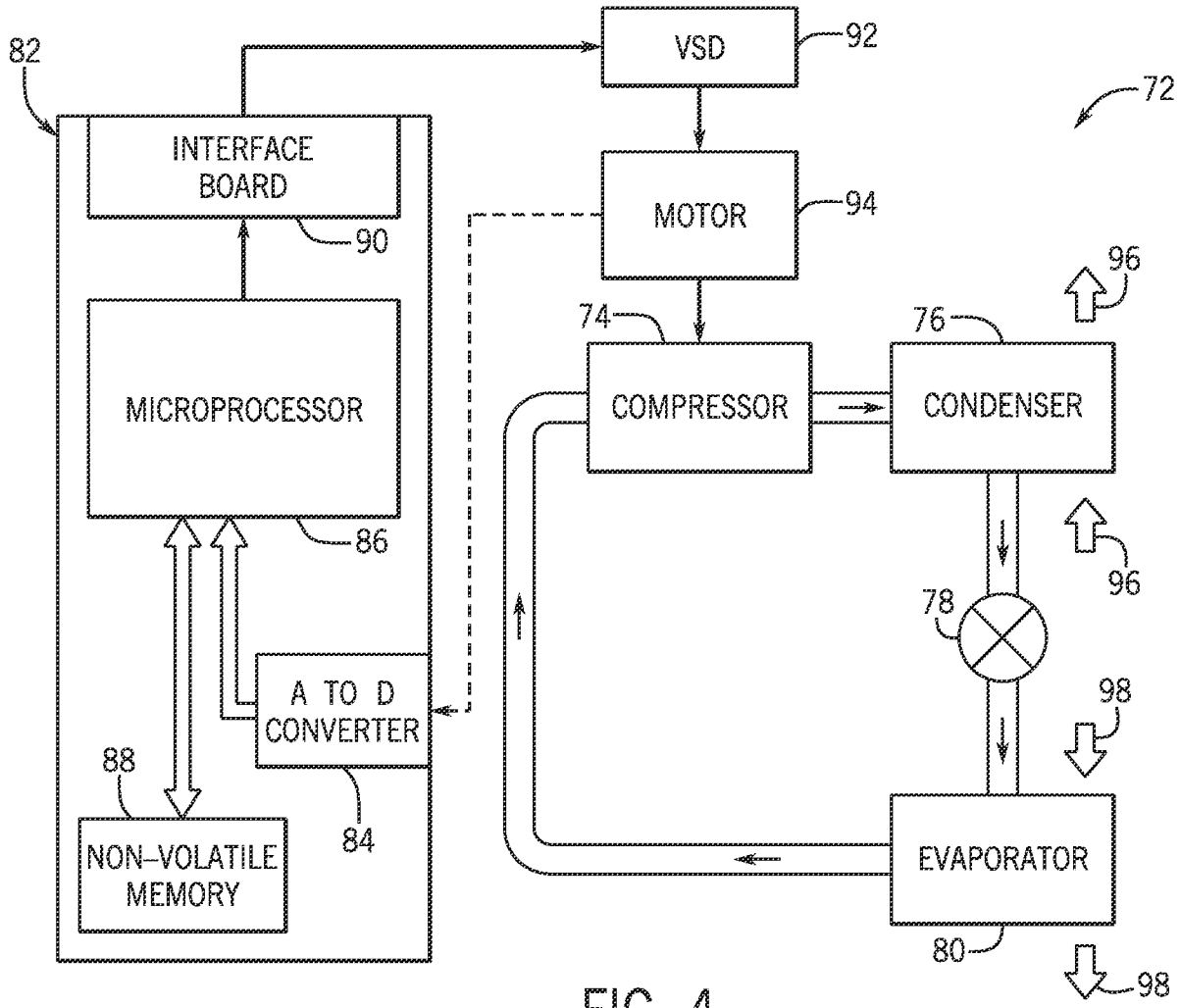
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid.

Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, embodiments of the present disclosure are directed to an HVAC system having an improved heat pump system. In particular, the heat pump system may include a working fluid circuit having an economizer and/or having a compressor configured to receive an injection of working fluid (e.g., vapor working fluid, two-phase working fluid) at an intermediate location or stage of the compressor (e.g., between the suction port and discharge port of the compressor). The heat pump system may also include a plurality of expansion devices and a control system configured to regulate operation of the plurality of expansion devices to enable more efficient operation of the heat pump system in heating and cooling operating modes, as well as more efficient operation of the heat pump system across a wider range of operating conditions (e.g., hot climates, cold climates) and a wider range of operating capacities. In the manners described below, the present techniques provide energy efficient heat pumps configured to operate and satisfy heating demands, such as in cold climate conditions, with improved efficiency, reduced energy consumption, and without operation of a furnace or other heating system configured to combust or consume a fuel, thereby enabling a reduction of greenhouse gas emissions.

Figure 5:
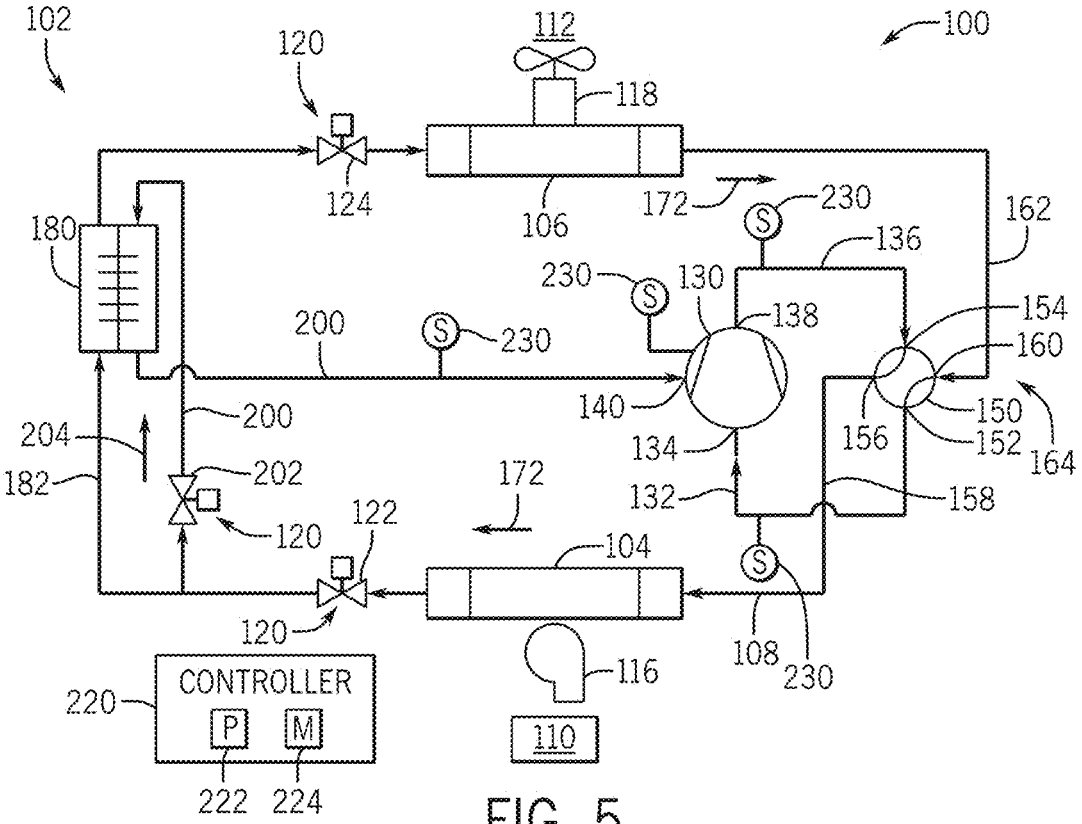
FIG. 5 is a schematic diagram of an embodiment of a portion of an HVAC system including a heat pump system with a subcooler, a compressor injection conduit, and a controller, in accordance with an aspect of the present disclosure.

To provide context for the following discussion, FIG. 5 is a schematic of an embodiment of a portion of an HVAC system 100 that includes a heat pump 102 (e.g., a heat pump system, reverse cycle heat pump, air source heat pump, an energy efficient heat pump) in accordance with present embodiments. The heat pump 102 may include one or more components of the vapor compression system 72 discussed above and/or may be included in any of the systems described above (e.g., the HVAC unit 12, the heating and cooling system 50). The heat pump 102 includes a first heat exchanger 104 and a second heat exchanger 106 that are fluidly coupled to one another via a working fluid circuit 108 or working fluid loop (e.g., one or more conduits, refrigerant circuit). The first heat exchanger 104 may be in thermal communication with (e.g., fluidly coupled to) a thermal load 110 (e.g., a room, space, and/or device) serviced by the heat pump 102, and the second heat exchanger 106 may be in thermal communication with an ambient environment 112 (e.g., the atmosphere) surrounding the HVAC system 100.

In some embodiments, a first fan 116 (e.g., blower) may direct a first air flow across the first heat exchanger 104 to facilitate heat exchange between working fluid within the first heat exchanger 104 and the thermal load 110, while a second fan 118 may direct a second air flow across the second heat exchanger 106 to facilitate heat exchange between working fluid within the second heat exchanger 106 and the ambient environment 112. One or more expansion devices 120 (e.g., an electronic expansion valve [EEV], a bi-directional expansion valve) may be disposed along the working fluid circuit 108 between the first heat exchanger 104 and the second heat exchanger 106 and may be configured to regulate (e.g., throttle) a flow of working fluid and/or a working fluid pressure differential between the first and second heat exchangers 104, 106. In the illustrated embodiment, the working fluid circuit 108 includes a first expansion device 122 (e.g., indoor expansion device, EEV) disposed along the working fluid circuit 108 proximate the first heat exchanger 104 and a second expansion device 124 (e.g., outdoor expansion device, EEV) disposed along the working fluid circuit 108 proximate the second heat exchanger 106. However, as discussed below, in other embodiments the heat pump 102 may include either the first expansion device 122 or the second expansion device 124.

The heat pump 102 also includes a compressor 130 (e.g., compressor system) disposed along the working fluid circuit 108. The compressor 130 is configured to direct working fluid flow through the first heat exchanger 104, the second heat exchanger 106, and remaining components (e.g., the expansion device(s) 120) that may be fluidly coupled to the working fluid circuit 108. Although one compressor 130 is shown in the illustrated embodiment, the heat pump 102 may include any suitable quantity of compressors 130, such as two, three, four, five, six, or more than six compressors 130. The compressor 130 may be a multi-stage (e.g., two stage) compressor and/or a variable speed compressor. Additionally, the compressor 130 may be a high-side shell compressor, a rotary compressor, a scroll compressor, and/or any other suitable type of compressor. The compressor 130 is configured to receive working fluid (e.g., a primary flow of working fluid) via a suction conduit 132 fluidly coupled to a suction port 134 of the compressor 130 and to discharge working fluid (e.g., compressed working fluid) via a discharge conduit 136 fluidly coupled to a discharge port 138 of the compressor 130. Further, the compressor 130 is also configured to receive an injected flow of working fluid (e.g., a secondary flow of working fluid) via one or more injection ports 140 of the compressor 130, as described in further detail below.

The compressor 130 may be fluidly coupled to a remainder of the working fluid circuit 108 via a reversing valve 150 (e.g., a switch-over valve). In the illustrated embodiment, the reversing valve 150 includes a first port 152 that is fluidly coupled to the suction conduit 132, a second port 154 that is fluidly coupled to the discharge conduit 136, a third port 156 that is fluidly coupled to a first conduit portion 158 extending to the first heat exchanger 104, and a fourth port 160 that is fluidly coupled to a second conduit portion 162 extending to the second heat exchanger 106.

The reversing valve 150 is configured to transition between a first configuration 164, in which the reversing valve 150 fluidly couples the first port 152 and the fourth port 160, and fluidly couples the second port 154 and the third port 156, and a second configuration 170 (FIGS. 12 and 13), in which the reversing valve 150 fluidly couples the first port 152 and the third port 156, and fluidly couples the second port 154 and the fourth port 160. Accordingly, in the first configuration 164, the reversing valve 150 enables the compressor 130 to receive a flow of working fluid from the second heat exchanger 106 and to discharge a flow of working fluid to the first heat exchanger 104. Conversely, in the second configuration 170, the reversing valve 150 enables the compressor 130 to receive a flow of working fluid from the first heat exchanger 104 and to discharge a flow of working fluid to the second heat exchanger 106. In this way, while in the first configuration 164, the reversing valve 150 enables the heat pump 102 to operate in a heating mode, in which the first heat exchanger 104 rejects thermal energy to the thermal load 110 to heat the thermal load 110, and the second heat exchanger 106 absorbs thermal energy from the ambient environment 112. Further, while in the second configuration 170, the reversing valve 150 enables the heat pump 102 to operate in a cooling mode, in which the first heat exchanger 104 absorbs thermal energy from the thermal load 110 to cool the thermal load 110, and the second heat exchanger 106 rejects the absorbed thermal energy (e.g., as absorbed from the thermal load 110) to the ambient environment 112. As such, while the reversing valve 150 is in the first configuration 164, the compressor 130 may direct a working fluid flow along at least a portion of the working fluid circuit 108 in a first flow direction 172. While the reversing valve 150 is in the second configuration 170 (FIGS. 12 and 13), the compressor 130 may direct a working fluid flow along at least a portion of the working fluid circuit 108 in a second flow direction 174, opposite the first flow direction 172.

The heat pump 102 may also include additional components, such as an economizer 180 (e.g., subcooler) disposed along a third conduit portion 182 extending between the first heat exchanger 104 and the second heat exchanger 106. The economizer 180 is configured to reduce a temperature and/or pressure of working fluid flowing along the third conduit portion 182 between the first heat exchanger 104 and the second heat exchanger 106, as described in further detail below.

As mentioned above, the heat pump 102 is also configured to enable injection of working fluid into the compressor 130. Specifically, present embodiments include the heat pump 102 configured to divert a portion of working fluid within the working fluid circuit 108 and inject the portion of working fluid into the compressor 130 via the injection port 140 of the compressor 130. To this end, the heat pump 102 (e.g., the working fluid circuit 108) includes an injection conduit 200 (e.g., subcooling conduit, compressor injection conduit) extending from the third conduit portion 182 (e.g., a liquid conduit portion) of the working fluid circuit 108 to the injection port 140 of the compressor 130. In the illustrated embodiment, the injection conduit 200 extends from the third conduit portion 182 at a location between the economizer 180 and the first expansion device 122. The injection conduit 200 extends to the economizer 180 and from the economizer 180 to the injection port 140 of the compressor 130. Thus, the injection conduit 200 may direct a portion of working fluid flow from the working fluid circuit 108 (e.g., downstream of the first expansion device 122), through the economizer 180, and then to the injection port 140 of the compressor 130. A third expansion device 202 (e.g., one of the expansion devices 120, injection expansion device, EEV) is disposed along the injection conduit 200 between the third conduit portion 182 of the working fluid circuit 108 and the economizer 180. The third expansion device 202 may reduce a pressure and/or temperature of the portion of working fluid directed along the injection conduit 200. As a result, the portion of working fluid directed along the injection conduit 200 to the economizer 180 may have a lower temperature and/or pressure than remaining working fluid in the third conduit portion 182 directed to the economizer 180. For example, the portion of working fluid directed along the injection conduit 200 to the economizer 180 may be in a vapor phase, and the remaining working fluid in the third conduit portion 182 directed to the economizer 180 may be in a liquid phase.

The economizer 180 enables transfer of thermal energy between the portion of working fluid directed through the injection conduit 200 and remaining working fluid directed along the third conduit portion 182 of the working fluid circuit 108. As the portion of working fluid directed along the injection conduit 200 may have a lower temperature than remaining working fluid in the third conduit portion 182 in the illustrated embodiment, the portion of working fluid within the injection conduit 200 may absorb heat from the remaining working fluid in the third conduit portion 182 via the economizer 180. The economizer 180 may include any suitable type or configuration of heat exchanger that enables heat transfer between two fluids (e.g., plate heat exchanger, co-axial heat exchanger, etc.). Further, in the illustrated embodiment the third conduit portion 182 and the injection conduit 200 are configured to direct respective flows of working fluid through the economizer 180 in a counterflow arrangement. However, other embodiments of the heat pump 102 may include different configurations, as discussed below.

Working fluid directed from the economizer 180 along the injection conduit 200 may be a liquid-vapor mixture and/or may be a working fluid vapor. The working fluid within the injection conduit 200 is directed from the economizer 180 to the injection port 140 of the compressor 130 to enable improved operation of the heat pump 102. For example, the injection of working fluid into the compressor 130 may enable improved operation of the heat pump 102 in cold climate conditions (e.g., cold temperatures of the ambient environment 112). As will be appreciated, in cold climate conditions, superheat of the working fluid discharged by the compressor 130 may be greater than desired (e.g., in the heating mode of the heat pump 102) Accordingly, the heat pump 102 may operate to direct vapor working fluid and/or a vapor-liquid mixture of working fluid into the compressor 130 via the injection conduit 200 and injection port 140, which may cause cooling of working fluid within the compressor 130 and reduce the superheat of the working fluid discharged by the compressor 130. The injected working fluid may also cause cooling of the compressor 130, which may improve the efficiency of the compressor 130 and reduce energy consumption of the compressor 102. In this way, the present techniques may enable improved operation of the heat pump 102 in cold climate conditions.

Additionally or alternatively, the injection conduit 200 may inject working fluid into the compressor 130 to increase an operating capacity of the compressor 130, the first heat exchanger 104, the second heat exchanger 106, and/or the heat pump 102 generally. As mentioned above, the working fluid injected into the compressor 130 via the injection port 140 is combined with a primary flow of working fluid received via the suction conduit 132. Thus, a mass flow rate of working fluid discharged by the compressor 130 is greater that a mass flow rate of working fluid received by the compressor 130 via the suction conduit 132. In some instances, the increase in mass flow rate of working fluid discharged by the compressor 130 may enable an increase in a heating capacity of the heat pump 102 (e.g., the first heat exchanger 104) in the heating mode of the heat pump 102.

As will be appreciated, the increased heating capacity of the heat pump 102 (e.g., the first heat exchanger 104) in the heating mode may enable the heat pump 102 to satisfy greater heating loads in cold climates without utilization of an auxiliary heating system, such as a furnace that combusts a fuel to provide supplemental heating capacity. In this way, present embodiments enable a reduction in the generation of greenhouse gas emissions. It should be appreciated that techniques similar to those described above may also be utilized during operation of the heat pump 102 in the cooling mode to enable improved (e.g., more efficient) operation of the heat pump 102.

In accordance with present techniques, the expansion devices 120 (e.g., EEVs) of the heat pump 102 may be controlled to further enable more efficient operation of the heat pump 102. For example, the expansion devices 120 may be controlled based on an operating mode of the heat pump 102, based on operating conditions or parameters of the heat pump 102, and/or based on other suitable factors. To this end, the HVAC system 100 includes a controller 220 (e.g., a control system, a thermostat, a control panel, control circuitry) that is communicatively coupled to one or more components of the heat pump 102 (e.g., expansion devices 120) and is configured to monitor, adjust, and/or otherwise control operation of the components of the heat pump 102. For example, one or more control transfer devices, such as wires, cables, wireless communication devices, and the like, may communicatively couple the compressor 130, the expansion device(s) 120, the first and/or second fans 116, 118, the control device 16 (e.g., a thermostat), and/or any other suitable components of the HVAC system 100 to the controller 220. That is, the compressor 130, the expansion device(s) 120, the first and/or second fans 116, 118, and/or the control device 16 may each have one or more communication components that facilitate wired or wireless (e.g., via a network) communication with the controller 220. In some embodiments, the communication components may include a network interface that enables the components of the HVAC system 100 to communicate via various protocols such as EtherNet/IP, ControlNet, DeviceNet, or any other communication network protocol. Alternatively, the communication components may enable the components of the HVAC system 100 to communicate via mobile telecommunications technology, Bluetooth®, near-field communications technology, and the like. As such, the compressor 130, the expansion device(s) 120, the first and/or second fans 116, 118, and/or the control device 16 may wirelessly communicate data between each other. In other embodiments, operational control of certain components of the heat pump 102 may be regulated by one or more relays or switches (e.g., a 24 volt alternating current [VAC] relay).

In some embodiments, the controller 220 may be a component of or may include the control panel 82. In other embodiments, the controller 220 may be a standalone controller, a dedicated controller, or another suitable controller included in the HVAC system 100. In any case, the controller 220 is configured to control components of the HVAC system 100 in accordance with the techniques discussed herein. The controller 220 includes processing circuitry 222, such as a microprocessor, which may execute software for controlling the components of the HVAC system 100. The processing circuitry 222 may include multiple microprocessors, one or more "general-purpose" microprocessors, one or more special-purpose microprocessors, and/or one or more application specific integrated circuits (ASICS), or some combination thereof. For example, the processing circuitry 222 may include one or more reduced instruction set (RISC) processors.

The controller 220 may also include a memory device 224 (e.g., a memory) that may store information, such as instructions, control software, look up tables, configuration data, etc. The memory device 224 may include a volatile memory, such as random access memory (RAM), and/or a nonvolatile memory, such as read-only memory (ROM). The memory device 224 may store a variety of information and may be used for various purposes. For example, the memory device 224 may store processor-executable instructions including firmware or software for the processing circuitry 222 execute, such as instructions for controlling components of the HVAC system 100 (e.g., expansion devices 120). In some embodiments, the memory device 224 is a tangible, non-transitory, machine-readable-medium that may store machine-readable instructions for the processing circuitry 222 to execute. The memory device 224 may include ROM, flash memory, a hard drive, or any other suitable optical, magnetic, or solid-state storage medium, or a combination thereof. The memory device 224 may store data, instructions, and any other suitable data.

In accordance with present techniques, the controller 220 is configured to control operation of the expansion devices 120 of the heat pump 102 to enable improved operation of the heat pump 102 in different operating modes and in different operating conditions of the heat pump 102. In this way, present embodiments enable more efficient operation of the heat pump 102 across a wider range of operating conditions in both heating and cooling modes of the heat pump 102. For example, the controller 220 may regulate operation of the expansion devices 120 to control flow of the working fluid through the injection conduit 200 to the injection port 140, such as to achieve a desired quality or characteristic of working fluid injected into the compressor 130. Additionally or alternatively, the controller 220 may regulate operation of the expansion devices 120 to achieve desired operating parameters of working fluid entering the compressor 130 via the suction port 134 (e.g., suction superheat) and/or desired operating parameters of the working fluid exiting the compressor 130 via the discharge port 138 (e.g., discharge superheat). To this end, the heat pump 102 may include one or more sensors 230 configured to detect one or more operating parameters of the heat pump 102, and the controller 220 may control operation of the expansion devices 120 (e.g., adjust a position of the expansion devices 120) based on feedback received from the one or more sensors 230. In some embodiments, one or more of the sensors 230 may be disposed along the discharge conduit 136 and may be configured to detect a temperature and/or a pressure of working fluid discharged by the compressor 130. Similarly, one or more of the sensors 230 may be disposed along the suction conduit 132 and may be configured to detect a temperature and/or a pressure of working fluid entering the compressor 130 via the suction port 134.

As mentioned above, the controller 220 may be configured to regulate operation of the expansion devices 120 based on various factors, such as an operating mode of the heat pump 102 (e.g., heating mode, cooling mode) and/or operating parameters or conditions of the heat pump 102 (e.g., of components of the heat pump 102). In some embodiments, the controller 220 may regulate operation of the expansion valves 120 according to a selected control sequence, which may be based on the heat pump 102 operating mode and/or operating conditions. Details of the controller 220 operations are described in further detail below with reference to FIGS. 16-19.

It should be appreciated that embodiments of the heat pump 102 may also include other components, such as an accumulator and/or a compensator. The accumulator may be configured to enable control of an amount of liquid working fluid circulating in the working fluid circuit 108. For example, the accumulator may enable adjustment in the amount of liquid working fluid circulating in the working fluid circuit 108 in low ambient conditions (e.g., cold temperatures in the ambient environment 112). In other modes of operation, the accumulator may act as a buffer tank to prevent too much liquid from entering the compressor 130 in transient modes of operation. The compensator may also be configured to enable control of an amount of working fluid circulating in the working fluid circuit 108. For example, the compensator may be configured to retain a portion of working fluid therein during the heating mode of the heat pump 102, such that the portion of retained working fluid does not circulate through the working fluid circuit 108, to improve operation of the heat pump 102 in the heating mode.

Figure 6:
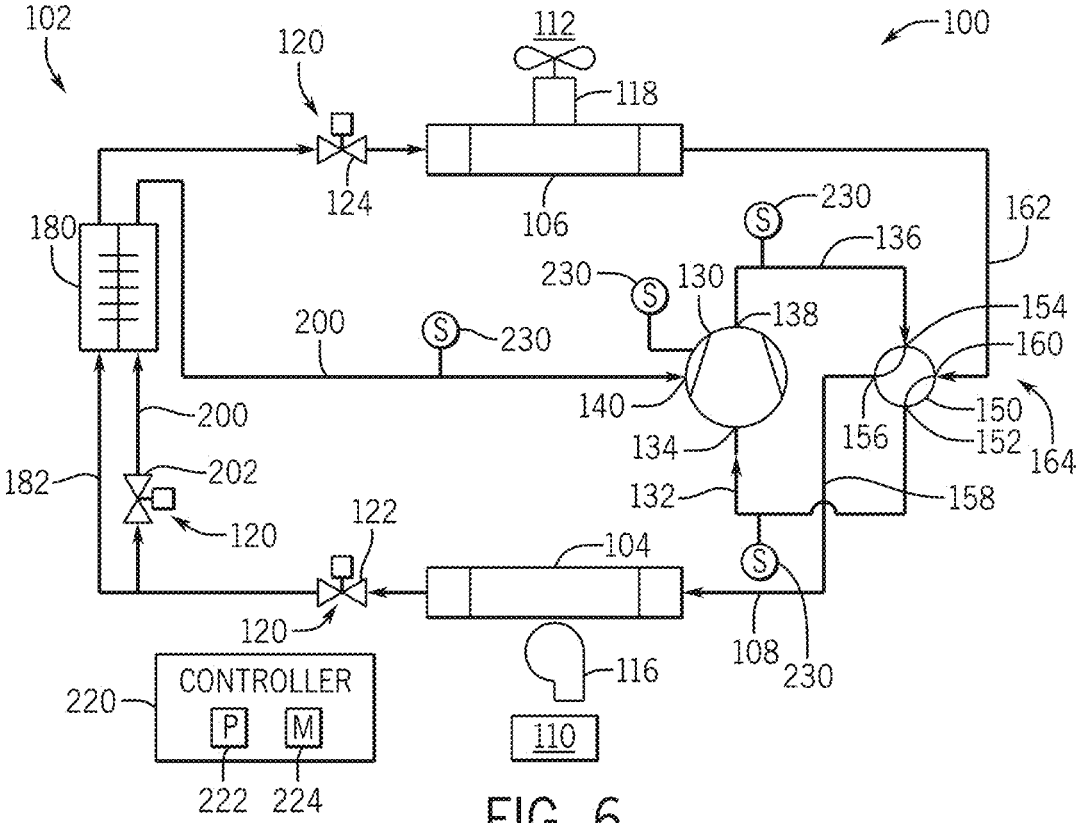
FIG. 6 is a schematic diagram of an embodiment of a portion of an HVAC system including a heat pump system with a subcooler, a compressor injection conduit, and a controller, in accordance with an aspect of the present disclosure.

FIGS. 6-15 are schematics of additional embodiments of the HVAC system 100 including the heat pump 102, in accordance with the present techniques. The embodiments illustrated in FIGS. 6-15 include certain elements and element numbers similar to those described above with reference to FIG. 5 and may be configured to operate in accordance with one or more of the control schemes described herein. For example, FIG. 6 illustrates an embodiment of the heat pump 102 similar to that of FIG. 5, with the heat pump 102 including the first, second, and third expansion devices 122, 124, and 202, the economizer 180, the injection conduit 200, and the reversing valve 150 in the first configuration 164. Thus, the heat pump 102 is configured for operation in the heating mode. The injection conduit 200 extends from the third conduit portion 182, through the economizer 180, and to the injection port 140 of the compressor 130. However, in the illustrated embodiment, the injection conduit 200 and the third conduit portion 182 are configured to direct respective flows of working fluid through the economizer 180 in a parallel flow arrangement instead of the counterflow arrangement illustrated in FIG. 5.

Figure 7:
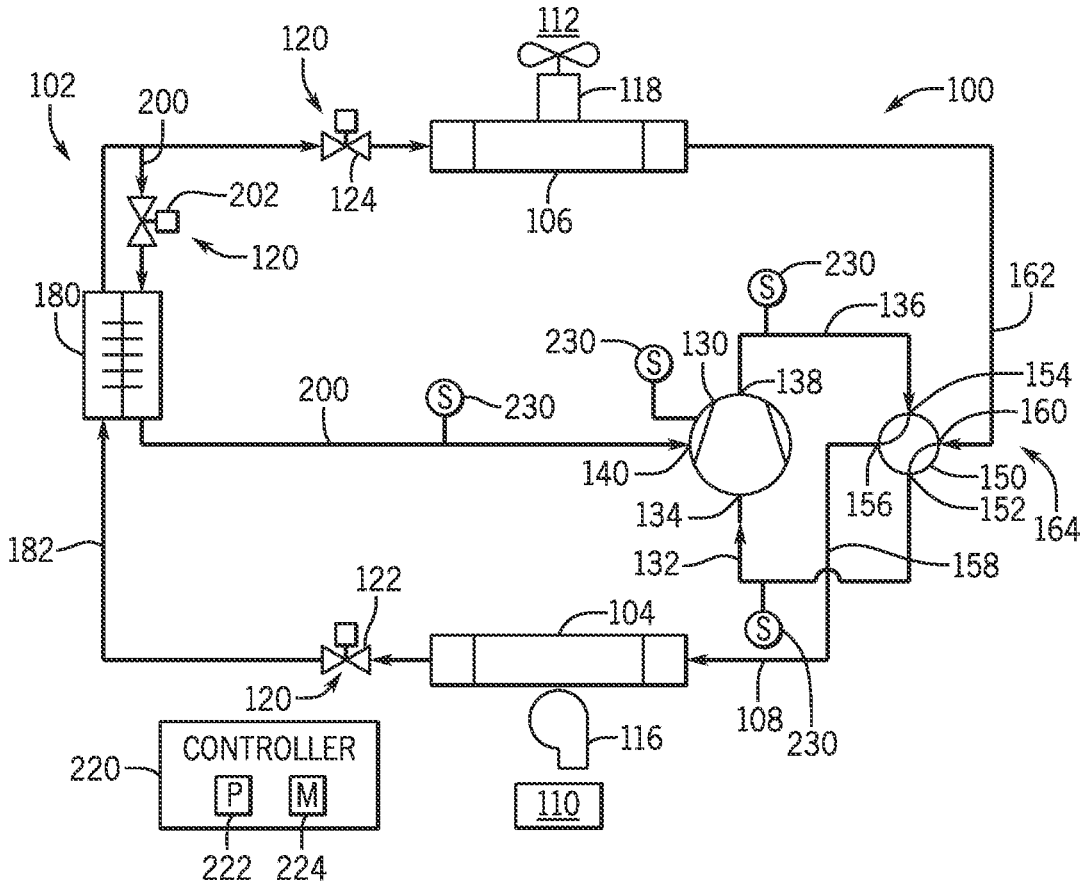
FIG. 7 is a schematic diagram of an embodiment of a portion of an HVAC system including a heat pump system with a subcooler, a compressor injection conduit, and a controller, in accordance with an aspect of the present disclosure.
Figure 8:
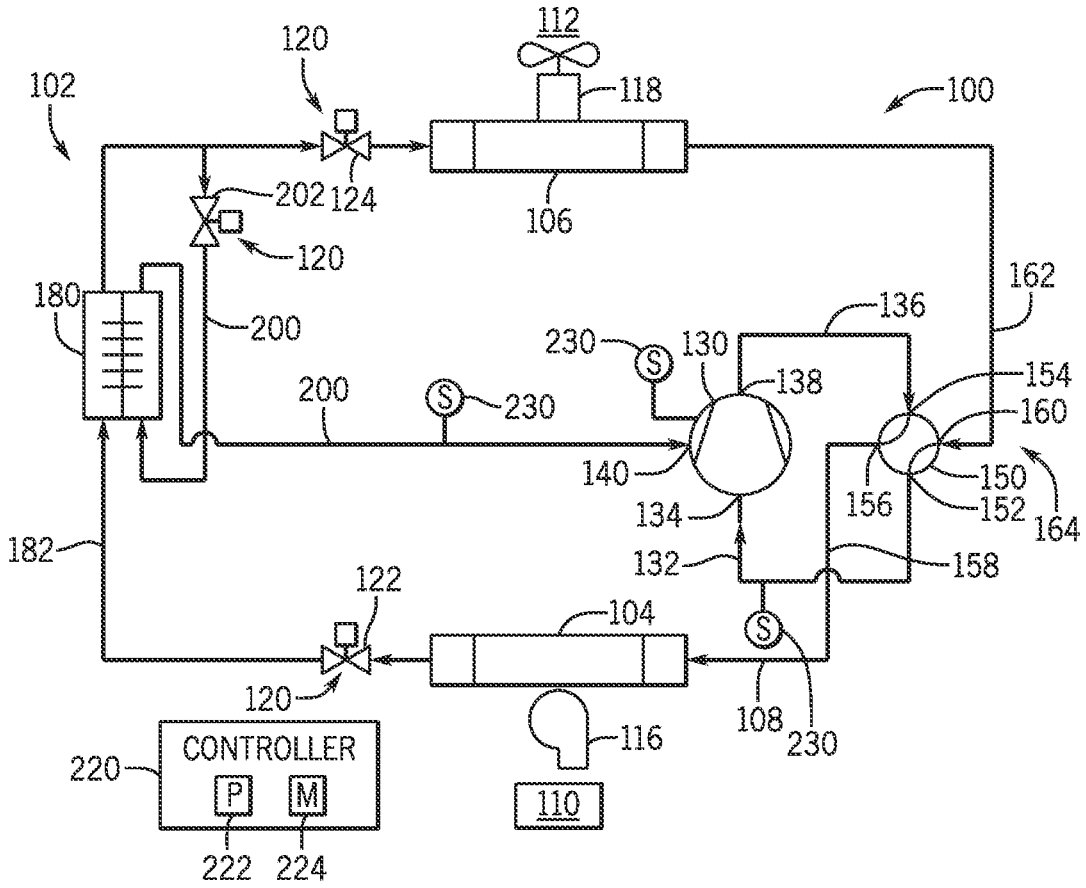
FIG. 8 is a schematic diagram of an embodiment of a portion of an HVAC system including a heat pump system with a subcooler, a compressor injection conduit, and a controller, in accordance with an aspect of the present disclosure.

FIG. 7 illustrates an embodiment of the heat pump 102 including the first, second, and third expansion devices 122, 124, and 202, the economizer 180, the injection conduit 200, and the reversing valve 150 in the first configuration 164. Thus, the heat pump 102 is configured for operation in the heating mode. In the illustrated embodiment, the injection conduit 200 extends from the third conduit portion 182 at a location between the economizer 180 and the second expansion device 124. The injection conduit 200 directs a portion of working fluid flow from the third conduit portion 182, through the economizer 180, and to the injection port 140 of the compressor 130. Additionally, the injection conduit 200 and the third conduit portion 182 are configured to direct respective working fluid flows through the economizer 180 in a counterflow arrangement. The illustrated embodiment of FIG. 8 is similar to that of FIG. 7. However, in FIG. 8, the injection conduit 200 extends from the third conduit portion 182 at a location between the economizer 180 and the second expansion device 124 and directs working fluid through the economizer 180 in a parallel arrangement with working fluid directed through the economizer 180 via the third conduit portion 182.

Figure 9:
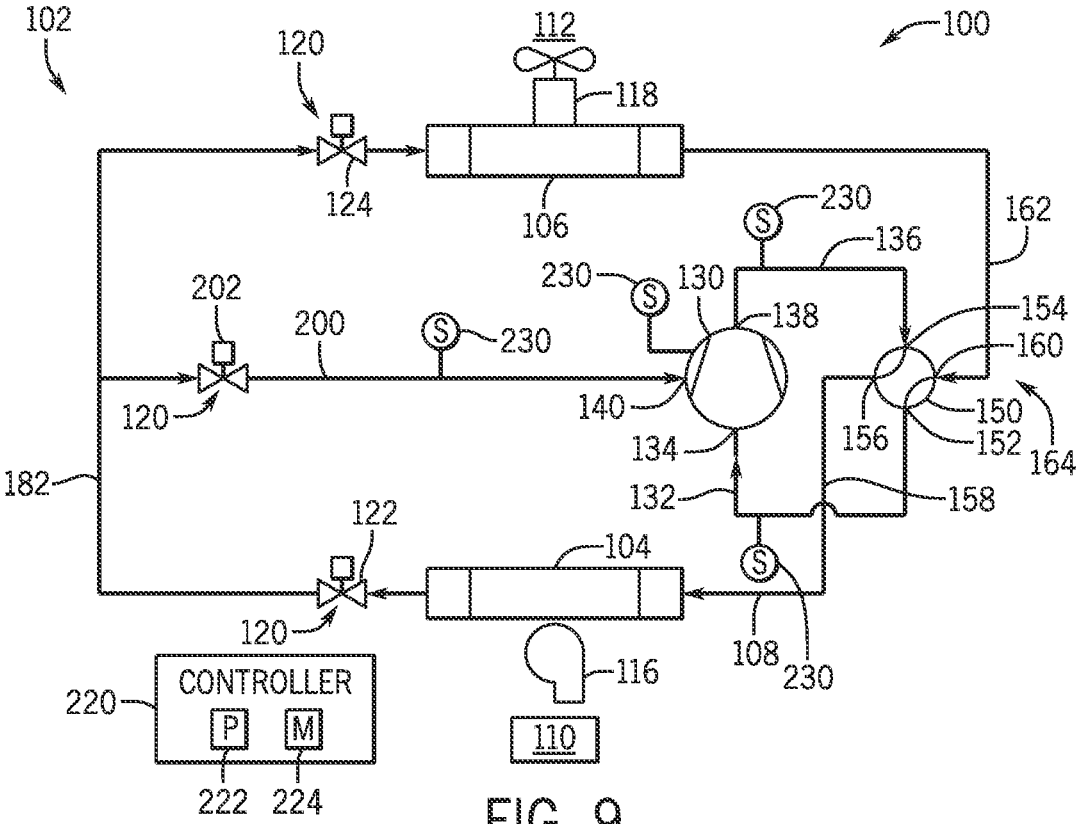
FIG. 9 is a schematic diagram of an embodiment of a portion of an HVAC system including a heat pump system with a compressor injection conduit and a controller, in accordance with an aspect of the present disclosure.

FIG. 9 illustrates an embodiment of the heat pump 102 including the first, second, and third expansion devices 122, 124, and 202, the injection conduit 200, and the reversing valve 150 in the first configuration 164. Thus, the heat pump 102 is configured for operation in the heating mode. However, the illustrated embodiment of FIG. 9 does not include the economizer 180. Instead, the injection conduit 200 having the third expansion device 202 extends directly from the third conduit portion 182 to the injection port 140 of the compressor 130. The third expansion device 202 may at least partially vaporize working fluid directed along the injection conduit 200 from the third conduit portion 182, and the at least partially vaporized working fluid may be injected into the compressor 130 via the injection port 140.

Figure 10:
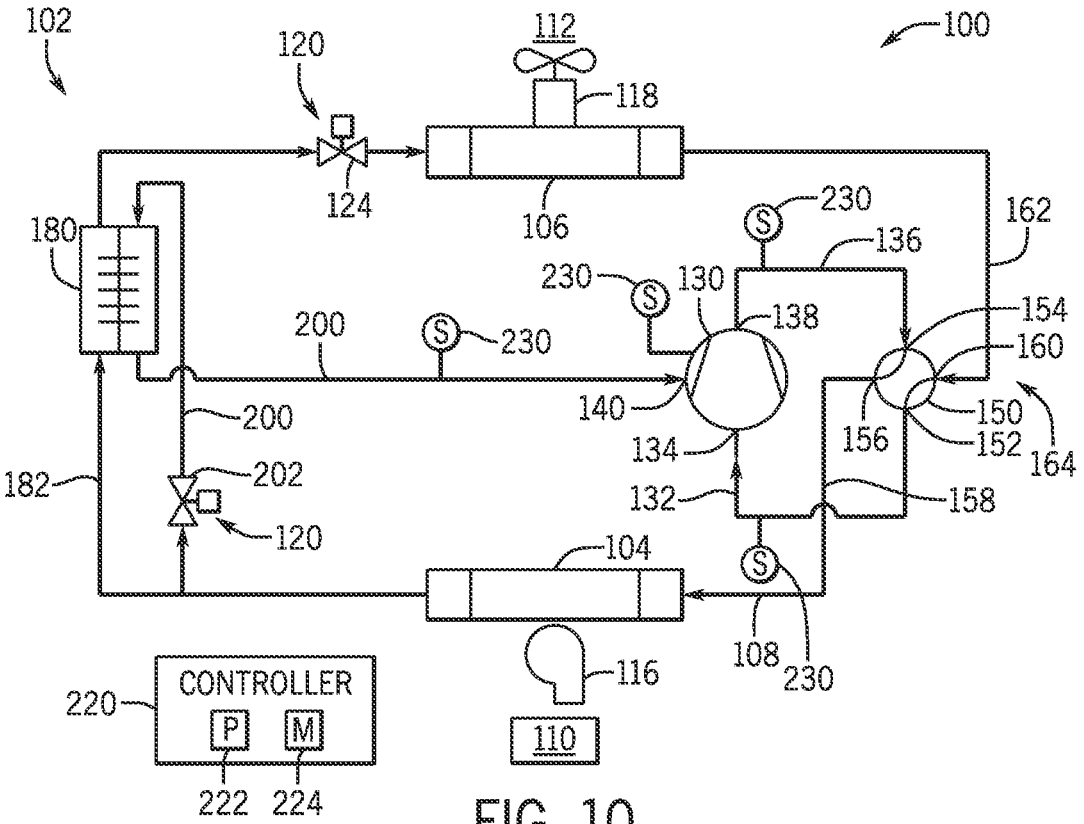
FIG. 10 is a schematic diagram of an embodiment of a portion of an HVAC system including a heat pump system with a subcooler, a compressor injection conduit, and a controller, in accordance with an aspect of the present disclosure.

FIG. 10 illustrates an embodiment of the heat pump 102 including the second and third expansion devices 124 and 202, the economizer 180, the injection conduit 200, and the reversing valve 150 in the first configuration 164. Thus, the heat pump 102 is configured for operation in the heating mode. The heat pump 102 does not include the first expansion device 122. Thus, working fluid discharged from the first heat exchanger 104 and directed along the third conduit portion 182 to the economizer 180 may be in a liquid phase. A portion of the working fluid discharged from the first heat exchanger 104 may be directed from the third conduit portion 182 to the economizer 180 via the injection conduit 200. The third conduit portion 182 and the injection conduit 200 are configured to direct respective working fluid flows through the economizer 180 in a counterflow arrangement. The third expansion device 202 disposed along the injection conduit 200 may reduce a temperature of the portion of working fluid, which may enable cooling of remaining working fluid within the third conduit portion 182 via heat exchange with the portion of working fluid directed through the economizer 180 via the injection conduit 200. As will be appreciated, the illustrated embodiment may be configured to enable injection of working fluid into the compressor 130 via the injection port 140 and the injection conduit 200 in the heating mode of the heat pump 102, but the heat pump 102 may not operate to inject working fluid into the compressor 130 via the injection port 140 and the injection conduit 200 in a cooling mode of the illustrated heat pump 102.

Figure 11:
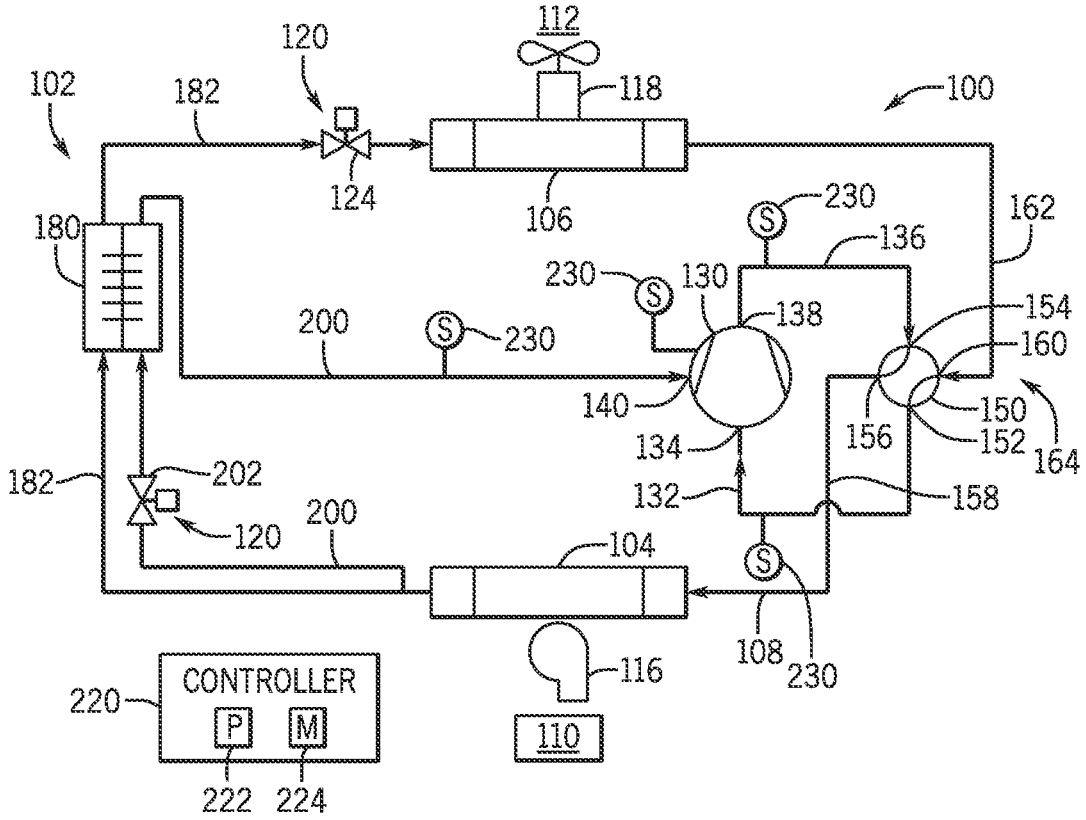
FIG. 11 is a schematic diagram of an embodiment of a portion of an HVAC system including a heat pump system with a subcooler, a compressor injection conduit, and a controller, in accordance with an aspect of the present disclosure.

The illustrated embodiment of FIG. 11 is similar to that of FIG. 10. However, in FIG. 11, the injection conduit 200 extends from the third conduit portion 182 at a location between the economizer 180 and the first heat exchanger 104 and directs working fluid through the economizer 180 in a parallel flow arrangement with working fluid directed through the economizer 180 via the third conduit portion 182.

Figure 12:
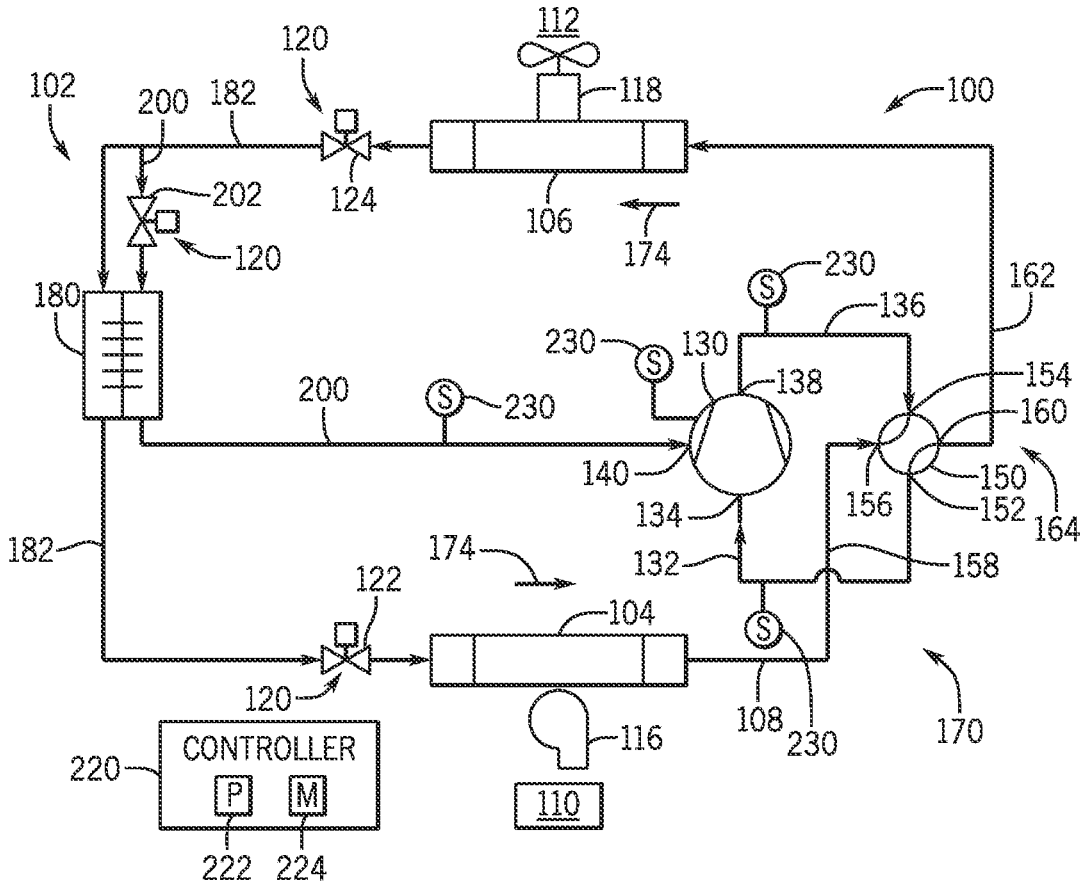
FIG. 12 is a schematic diagram of an embodiment of a portion of an HVAC system including a heat pump system with a subcooler, a compressor injection conduit, and a controller, in accordance with an aspect of the present disclosure.

FIG. 12 illustrates an embodiment of the heat pump 102 including the first and third expansion devices 122 and 202, the economizer 180, the injection conduit 200, and the reversing valve 150 in the second configuration 170. Thus, the heat pump 102 is configured for operation in the cooling mode. The heat pump 102 does not include the second expansion device 124. Thus, working fluid discharged from the second heat exchanger 106 and directed along the third conduit portion 182 to the economizer 180 may be in a liquid phase. A portion of the working fluid discharged from the second heat exchanger 106 may be directed from the third conduit portion 182 to the economizer 180 via the injection conduit 200 extending from the third conduit portion 182. The third expansion device 202 may reduce a temperature of the portion of working fluid directed along the injection conduit 200, which may enable transfer of thermal energy from working fluid directed through the third conduit portion 182 to the portion of working fluid directed through the injection conduit 200 via the economizer 180. In the illustrated embodiment, the third conduit portion 182 and the injection conduit 200 are configured to direct respective working fluid flows through the economizer 180 in a parallel flow arrangement. As will be appreciated, the illustrated embodiment may be configured to enable injection of working fluid into the compressor 130 via the injection port 140 and the injection conduit 200 in the cooling mode of the heat pump 102, but the heat pump 102 may not operate to inject working fluid into the compressor 130 via the injection port 140 and the injection conduit 200 in a heating mode of the illustrated heat pump 102.

Figure 13:
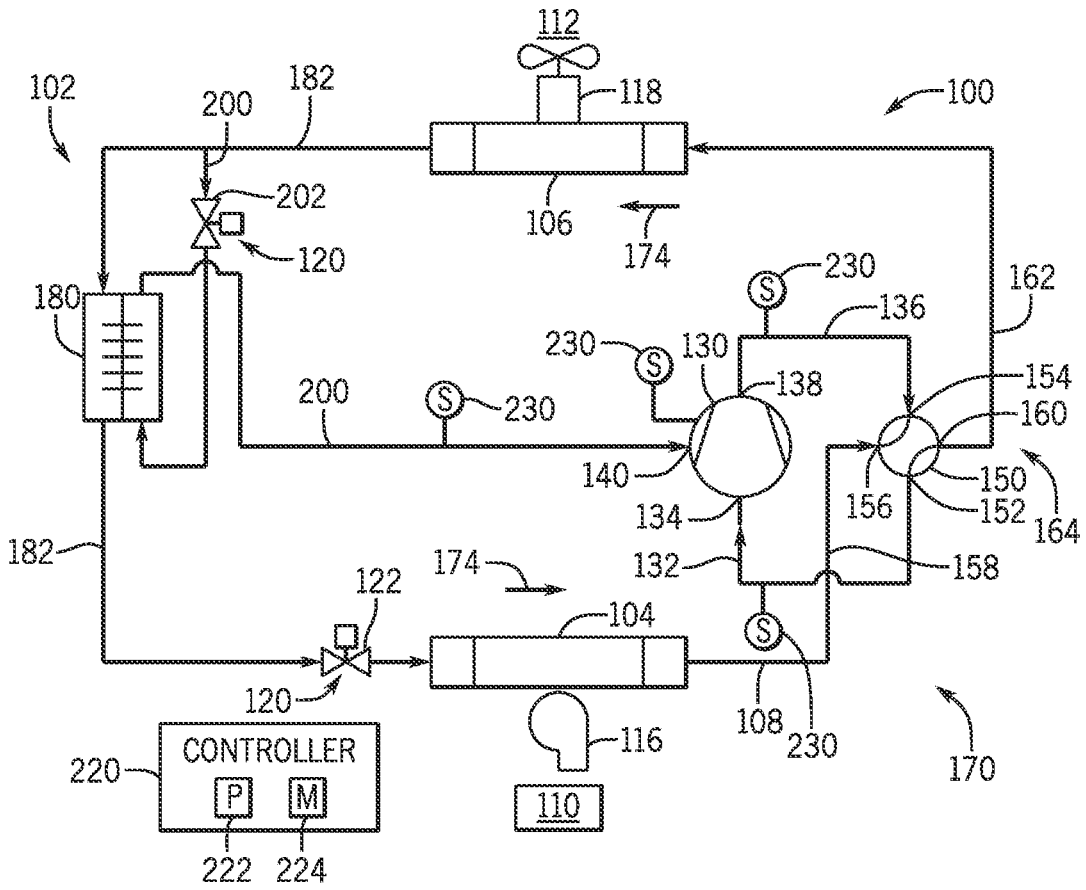
FIG. 13 is a schematic diagram of an embodiment of a portion of an HVAC system including a heat pump system with a subcooler, a compressor injection conduit, and a controller, in accordance with an aspect of the present disclosure.

The illustrated embodiment of FIG. 13 is similar to that of FIG. 12. However, in FIG. 12, the injection conduit 200 extends from the third conduit portion 182 at a location between the economizer 180 and the second heat exchanger 106 and directs working fluid through the economizer 180 in a counterflow arrangement with working fluid directed through the economizer 180 via the third conduit portion 182.

Figure 14:
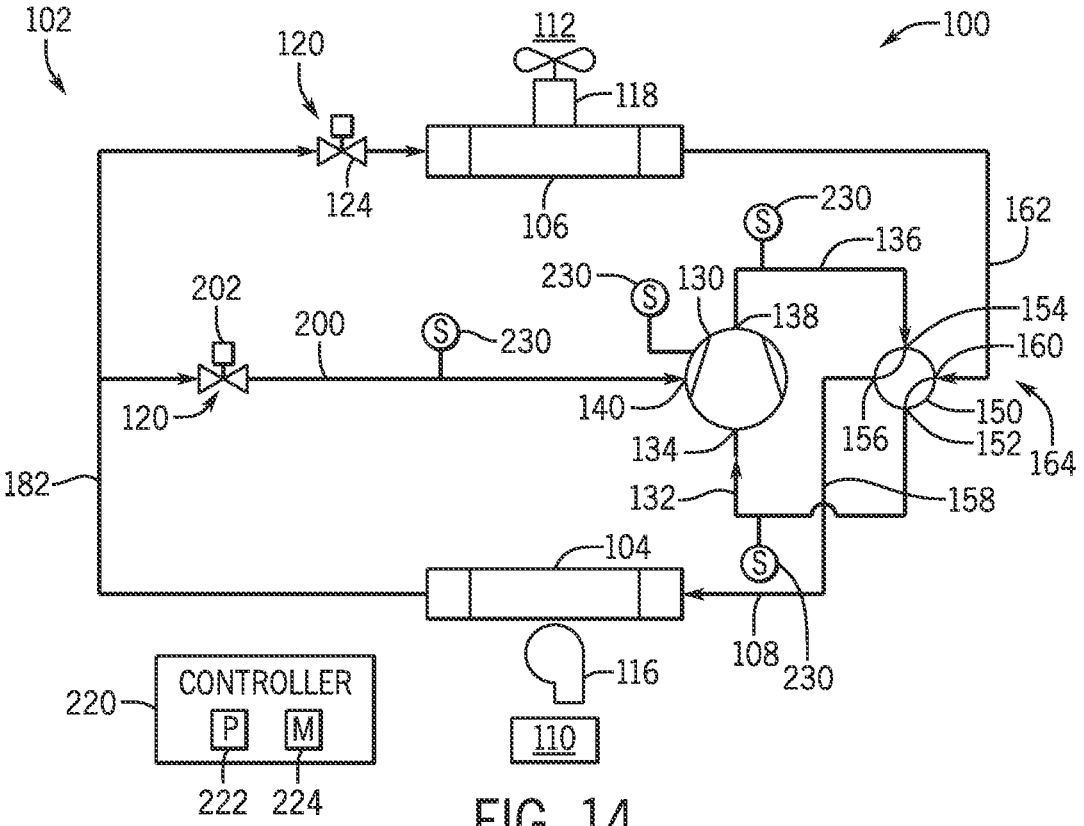
FIG. 14 is a schematic diagram of an embodiment of a portion of an HVAC system including a heat pump system with a compressor injection conduit and a controller, in accordance with an aspect of the present disclosure.

FIG. 14 illustrates an embodiment of the heat pump 102 including the second and third expansion devices 124 and 202, the injection conduit 200, and the reversing valve 150 in the first configuration 164. Thus, the heat pump 102 is configured for operation in the heating mode. The illustrated embodiment of FIG. 14 does not include the economizer 180 or the first expansion device 122. The injection conduit 200 having the third expansion device 202 extends directly from the third conduit portion 182 to the injection port 140 of the compressor 130. In the heating mode, the first heat exchanger 104 may discharge working fluid in a liquid phase to the third conduit portion 182, and a portion of the working fluid may be redirected to the injection conduit 200. The third expansion device 202 may at least partially vaporize the working fluid directed along the injection conduit 200 from the third conduit portion 182, and the at least partially vaporized working fluid may be injected into the compressor 130 via the injection port 140. In the illustrated embodiment, the heat pump 102 may not direct working fluid along the injection conduit 200 in a cooling mode. Instead, the third expansion device 202 may be in a closed position in the cooling mode.

Figure 15:
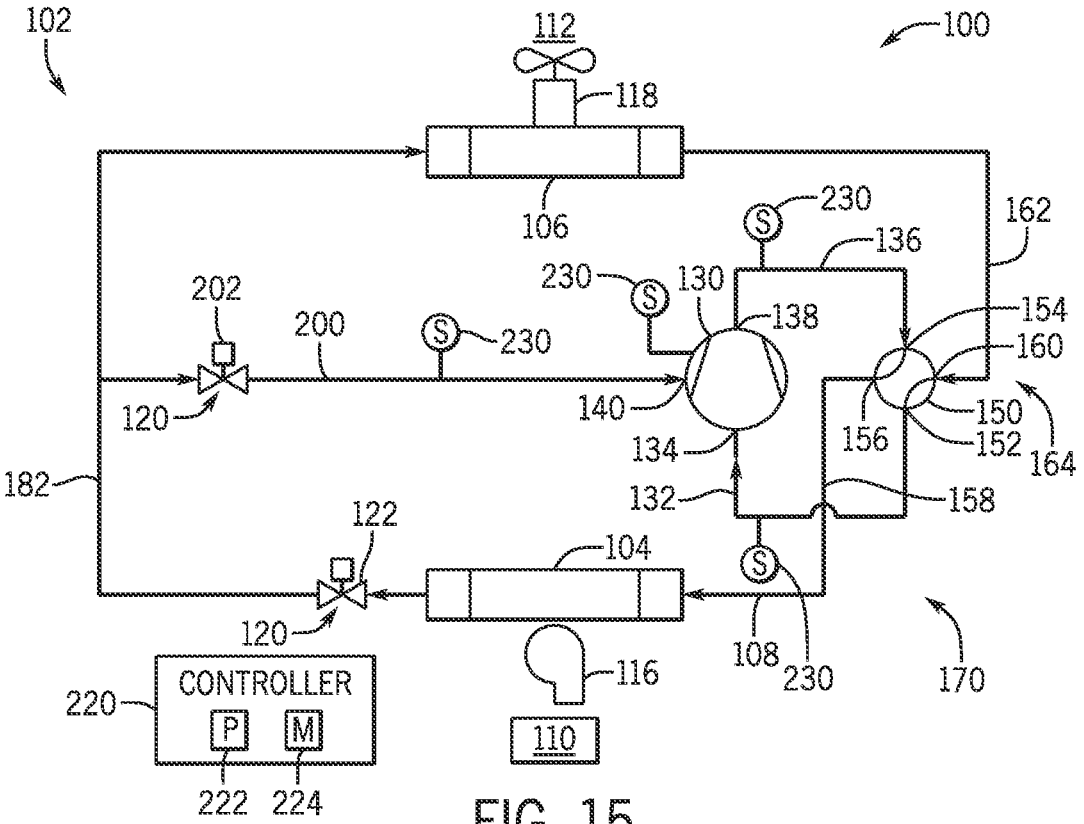
FIG. 15 is a schematic diagram of an embodiment of a portion of an HVAC system including a heat pump system with a compressor injection conduit and a controller, in accordance with an aspect of the present disclosure.

FIG. 15 illustrates an embodiment of the heat pump 102 including the first and third expansion devices 122 and 202, the injection conduit 200, and the reversing valve 150 in the second configuration 170. Thus, the heat pump 102 is configured for operation in the cooling mode. The illustrated embodiment of FIG. 15 does not include the economizer 180 or the second expansion device 124. The injection conduit 200 having the third expansion device 202 extends directly from the third conduit portion 182 to the injection port 140 of the compressor 130. In the cooling mode, the second heat exchanger 106 may discharge working fluid in a liquid phase to the third conduit portion 182, and a portion of the working fluid may be redirected to the injection conduit 200. The third expansion device 202 may at least partially vaporize the working fluid directed along the injection conduit 200 from the third conduit portion 182, and the at least partially vaporized working fluid may be injected into the compressor 130 via the injection port 140. In the illustrated embodiment, the heat pump 102 may not direct working fluid along the injection conduit 200 in a heating mode. Instead, the third expansion device 202 may be in a closed position in the heating mode.

As discussed above, embodiments of the present disclosure include the controller 220 configured to control operation of the expansion devices 120 of the heat pump 102 to enable more efficient operation of the heat pump 102 in a wider range of operating conditions. For example, the controller 220 may be configured to execute one or more control sequences for the expansion devices 120 based on an operating mode of the heat pump 102 and based on operating conditions of the heat pump 102. As described in further detail below, the control sequences executed by the controller 220 may enable control of the heat pump 102 to achieve one or more desired operating parameters (e.g., based on the operating mode and/or operating conditions of the heat pump 102. In this way, the present techniques enable more efficient operation of the heat pump 102 across a wider range of operating conditions.

Figure 16:
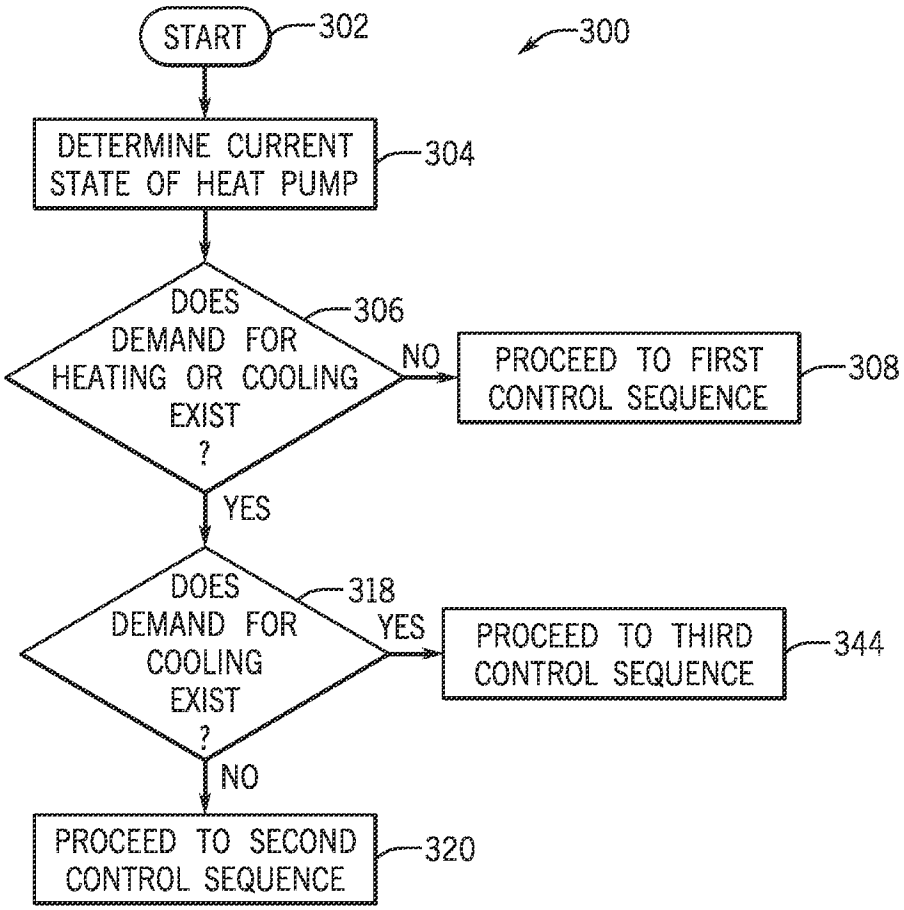
FIG. 16 is a flow chart of an embodiment of a method for controlling operation of an HVAC system including a heat pump system, in accordance with an aspect of the present disclosure.

With the foregoing in mind, FIG. 16 is a flow chart of an embodiment of a method 300 (e.g., control sequence, one or more control sequences) for operating the heat pump 102. As will be appreciated, the method 300 may be performed by the controller 220. For example, computer executable instructions or code for performing the method 300 may be stored on the memory device 224, and the processing circuitry 222 may execute the instructions to perform the method 300. In some embodiments, one or more steps of the method 300 may be performed by another controller of the HVAC system 100. In additional or alternative embodiments, multiple components or systems may perform the steps of the method 300. It should also be noted that additional steps may be performed with respect to the depicted method 300. Moreover, certain steps of the method 300 may be removed, modified, and/or performed in a different order. In some embodiments, certain steps of the method 300 may not be performed based on a configuration of the heat pump 102, such as based on a number and/or arrangement of the expansion devices 120 included in the heat pump 102. In embodiments of the heat pump 102 including the first, second, and third expansion devices 122, 124, and 202, the controller 220 may be configured to execute all or substantially all of the steps and/or control sequences of the method 300. Further still, the steps of the method 300 may be performed in any suitable relation with one another, such as in response to one another and/or in parallel with one another.

As indicated by block 302, operation of the heat pump 102 may be initiated. Then, at block 304, a current state of the heat pump 102 is determined. For example, the controller 220 may receive data and/or feedback indicative of operating temperatures and/or pressures (e.g., of refrigerant, of ambient air) associated with the heat pump 102, a speed of the compressor 130, a call for conditioning received by the heat pump 102, and so forth. In some instances, the data and/or feedback may be received from one or more of the sensors 230.

At block 306, a determination is made regarding whether a demand for heating or cooling of a space serviced by the heat pump 102 exists. If a demand for heating or cooling does not exist, the method 300 proceeds to a first control sequence 308 of the method 300. The first control sequence is described further below with reference to FIG. 17. In some circumstances, operation of the heat pump 102 may be initiated without an existing call for heating or cooling, such as following a power cycling of the heat pump 102, a restart of the heat pump 102, and so forth.

In response to a determination that a demand for heating or cooling does exist, the method proceeds to block 318. At block 318, a determination is made regarding whether a demand for cooling exists. If a demand for cooling does not exist (e.g., a demand for heating exists), the method 300 proceeds to a second control sequence 320 of the method 300. In other words, the second control sequence 320 may be executed in a heating mode of the heat pump 102. The second control sequence 320 is described further below with reference to FIG. 18.

In response to a determination that a demand for cooling exists at block 318, the method 300 proceeds to a third control sequence 344 of the method 300. In other words, the third control sequence 344 may be executed in a cooling mode of the heat pump 102 or a cooling mode of the HVAC system 100 configured as an air conditioner. The third control sequence 344 is described further below with reference to FIG. 19.

Figure 17:
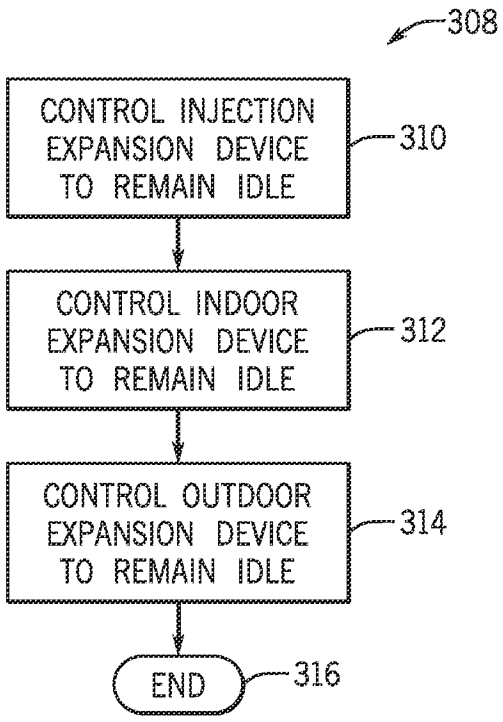
FIG. 17 is a flow chart of an embodiment of a first control sequence of a method for controlling operation of an HVAC system including a heat pump system, in accordance with an aspect of the present disclosure.

FIG. 17 is a flow chart of an embodiment of a portion of the method 300 including the first control sequence 308. As mentioned above, the method 300 may proceed to the first control sequence 308 in response to a determination that a demand for heating or cooling does not exist at block 306 of the method 300. The first control sequence 308 includes blocks 310, 312, and 314. At block 310, the third expansion device 202 (e.g., injection expansion device, EEV) disposed along the injection conduit 200 is controlled to remain idle. For example, the position of the third expansion device 202 may not be adjusted by the controller 220. Alternatively, the third expansion device 202 may be adjusted to a fully closed position. Similarly, at block 312, the first expansion device 122 (e.g., indoor expansion device, EEV) disposed along the third conduit portion 182 and adjacent to the first heat exchanger 104 is controlled to remain idle (e.g., remain in a last or most recent position), and at block 314, the second expansion device 124 (e.g., outdoor expansion device, EEV) disposed along the third conduit portion 182 and adjacent to the second heat exchanger 106 is controlled to remain idle (e.g., remain in a last or most recent position). Thereafter, the first control sequence 308 (e.g., the method 300) may proceed to block 316 to end the method 300. However, in some embodiments, the method 300 may proceed from block 316 and return to block 302, block 304, and/or block 306.

Figure 18:
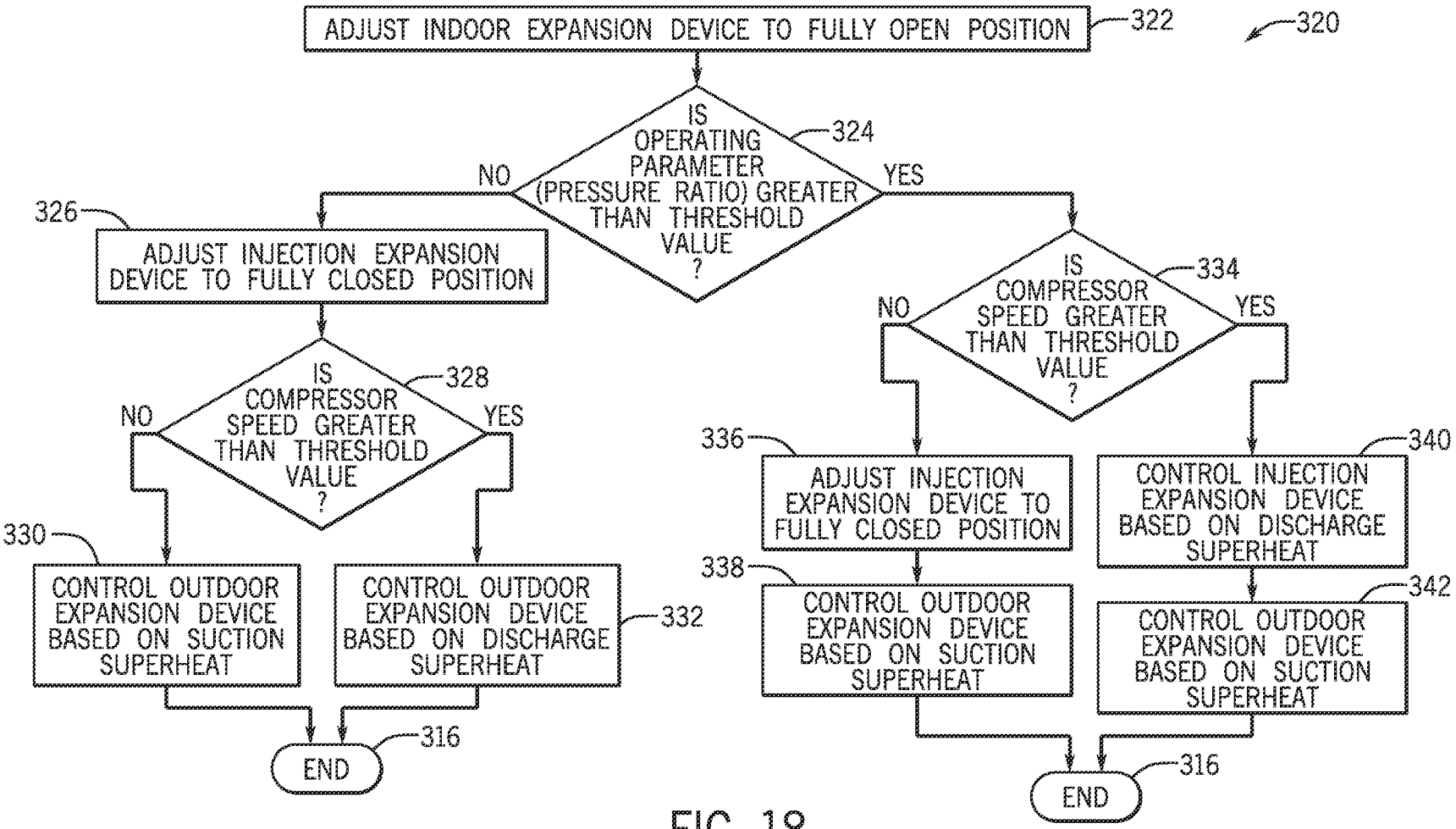
FIG. 18 is a flow chart of an embodiment of a second control sequence of a method for controlling operation of an HVAC system including a heat pump system, in accordance with an aspect of the present disclosure.
Figure 19:
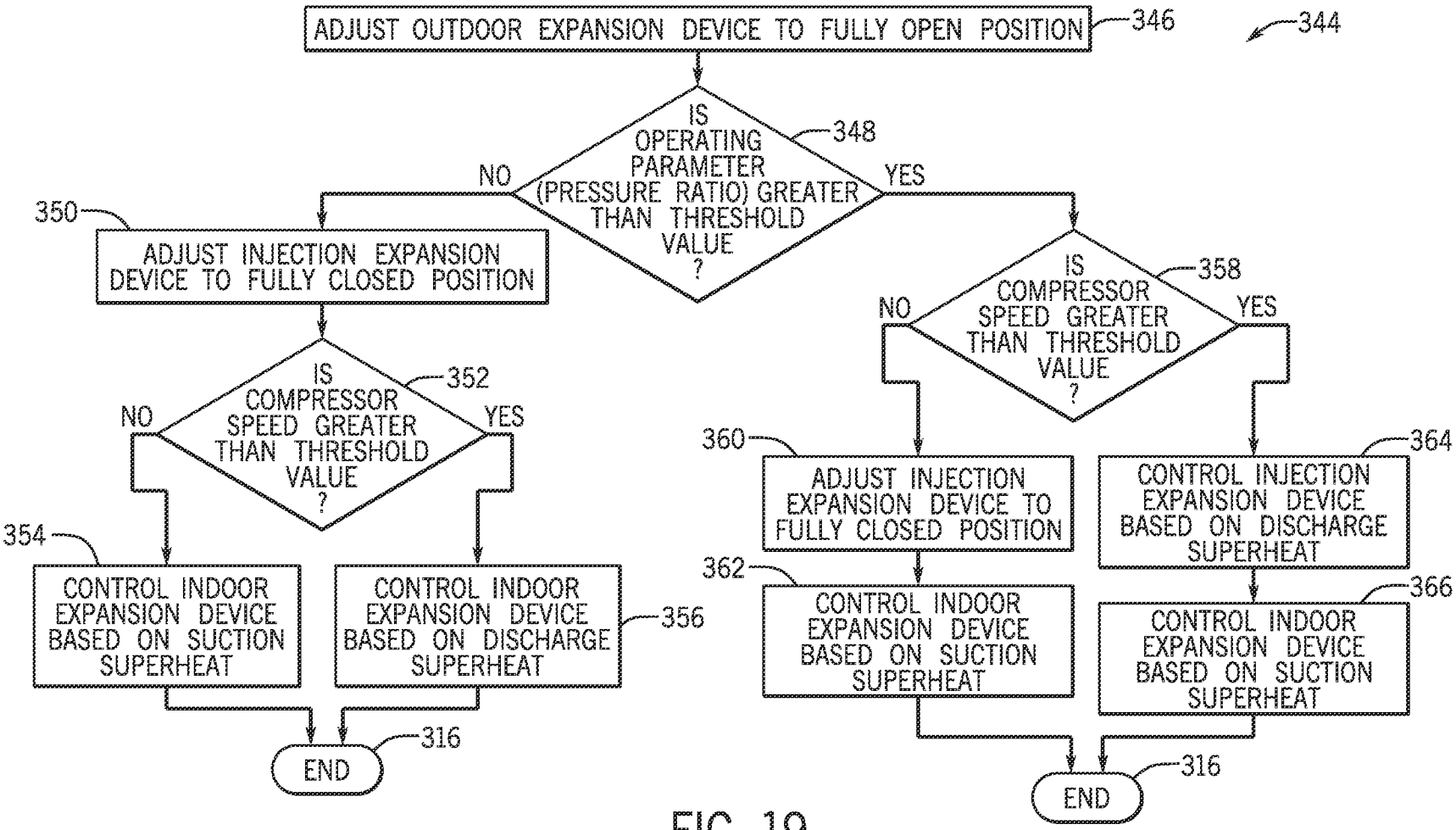
FIG. 19 is a flow chart of an embodiment of a third control sequence of a method for controlling operation of an HVAC system including a heat pump system, in accordance with an aspect of the present disclosure.

FIG. 18 is a flow chart of an embodiment of a portion of the method 300 including the second control sequence 320. As mentioned above, the method 300 may proceed to the second control sequence 320 in response to a determination that a demand for cooling does not exist at block 318 of the method 300. In other words, the second control sequence 320 may be executed in a heating mode of the heat pump 102.

The second control sequence 320 begins with block 322. At block 322, the first expansion device 122 (e.g., indoor EEV) is adjusted to a fully open position. In this way, working fluid discharged by the first heat exchanger 104 in the heating mode of the heat pump 102 may flow through the first expansion device 122 without throttling. In other words, the working fluid discharged from the first heat exchanger 122 may flow along the third conduit portion 182 (e.g., to the economizer 180, to the injection conduit 200, to the second expansion device 124) in a liquid phase.

The second control sequence 320 may then proceed to block 324. At block 324, an operating parameter of the heat pump 102 is compared to a threshold value to determine whether the operating parameter is greater than the threshold value. In the illustrated embodiment, the operating parameter may be a pressure ratio of the compressor 130 and/or heat pump 102. However, in other embodiments, another operating parameter of the heat pump 102 (e.g., ambient temperature) may be compared to a corresponding threshold value. To this end, the controller 220 may be configured to receive data and/or feedback from one or more sensors 230 of the heat pump 102, such as working fluid pressure sensors (e.g., suction pressure sensor, discharge pressure sensor), an ambient temperature sensor, or other suitable sensor.

For example, in response to a determination that a pressure ratio of the compressor 130 and/or heat pump 102 is not greater than a threshold value (e.g., 2.3, 2.5, 2.7), the second control sequence 320 may proceed to block 326. At block 326, the third expansion device 202 disposed along the injection conduit 200 is adjusted to a fully closed position. Thus, working fluid may not flow along the injection conduit 200, and working fluid may not be injected into the compressor 130 via the injection port 140. From block 326, the second control sequence 320 proceeds to block 328, whereby a speed of the compressor 130 is compared to a threshold value (e.g., 2300 revolutions per minute [RPM], 2400 RPM, 2500 RPM). Based on a determination that the speed of the compressor 130 is not greater than the threshold value, the second control sequence 320 may proceed to block 330. At block 330, the second expansion device 124 (e.g., outdoor EEV) is controlled to adjust suction superheat of the heat pump 102. For example, the controller 220 may control, adjust, or otherwise operate the second expansion device 124 to adjust the suction superheat of the heat pump 102 toward a target suction superheat set point. To this end, one or more values of the target suction superheat set point may be stored in the memory device 224 of the controller 220, and/or the controller 220 may receive feedback from one or more of the sensors 230 (e.g., temperature and/or pressure sensors disposed along the suction conduit 132) to determine whether adjustment of the second expansion device 124 is desired to achieve the suction superheat set point.

Based on a determination that the speed of the compressor 130 is greater than the threshold value, the second control sequence 320 may proceed to block 332. At block 332, the second expansion device 124 (e.g., outdoor EEV) is controlled to adjust discharge superheat of the heat pump 102. For example, the controller 220 may control, adjust, or otherwise operate the second expansion device 124 to adjust the discharge superheat of the heat pump 102 toward a target discharge superheat set point. One or more values of the target discharge superheat set point may be stored in the memory device 224 of the controller 220, and/or the controller 220 may receive feedback from one or more of the sensors 230 (e.g., temperature and/or pressure sensors disposed along the discharge conduit 136) to determine whether adjustment of the second expansion device 124 is desired to achieve the discharge superheat set point. As will be appreciated, control of the second expansion device 124 to achieve a discharge superheat set point in the heating mode may cause the second heat exchanger 106 to partially (i.e., not fully) evaporate the working fluid, such that an amount of liquid working fluid enters the compressor 130. As the compressor 130 may be a high-side shell compressor, the compressor 130 may be configured to receive some liquid working fluid at the suction port 132. In this operating condition, the suction pressure may increase, which may reduce power consumption of the compressor 130. The density of working fluid within the compressor 130 may also increase, which increases the mass flow of working fluid through the compressor 130 and thereby increases the capacity of the heat pump 102.

Returning to block 324, in response to a determination that a pressure ratio of the compressor 130 and/or heat pump 102 is greater than a threshold value, the method 300 may proceed to block 334. At block 334, a speed of the compressor 130 is compared to a threshold value (e.g., 2300 RPM, 2400 RPM, 2500 RPM). Based on a determination that the speed of the compressor 130 is not greater than (i.e., is equal to or less than) the threshold value, the method 300 may proceed to block 336. At block 336, the third expansion device 202 disposed along the injection conduit 200 is adjusted to a fully closed position. Thus, working fluid may not flow along the injection conduit 200 and working fluid may not be injected into the compressor 130 via the injection port 140. The method 300 then continues to block 338, whereby the second expansion device 124 (e.g., outdoor EEV) is controlled to adjust suction superheat of the heat pump 102, as similarly described above with reference to block 330.

Based on a determination that the speed of the compressor 130 is greater than the threshold value at block 334, the method 300 may proceed to block 340. At block 340, the third expansion device 202 (e.g., injection EEV) is controlled to adjust discharge superheat of the heat pump 102. For example, the controller 220 may control, adjust, or otherwise operate the third expansion device 202 to adjust flow of working fluid injected into the compressor 130 via the injection port 140 and thereby adjust the discharge superheat of the heat pump 102 toward a target discharge superheat set point. Thus, the mass flow rate of working fluid through the compressor 130 is increased, which decreases power consumption of the compressor 130. Additionally, at block 342, the controller 220 may control or adjust the second expansion device 124 to adjust the suction superheat of the heat pump 102 toward a target suction superheat set point (e.g., a positive superheat value), as similarly described above with reference to blocks 330 and 338. In this way, vapor working fluid may be directed to the suction port 132, and the mass flow rate of working fluid to the first heat exchanger 104 may be increased, which increases the heating output of the first heat exchanger 104 (e.g., to a supply air flow). Additionally, the injection of working fluid (e.g., vapor-liquid mixture) into the compressor 130 via the injection port 140 increases cooling of the compressor 130, which increases the operating range of the compressor 130.

As mentioned above, another operating parameter may be evaluated at block 324 (e.g., instead of pressure ratio) in the heating mode of the heat pump 102. For example, an ambient temperature may be compared to a threshold value. In such embodiments, in response to a determination that the ambient temperature is less than the threshold value (e.g., 40 degrees Fahrenheit), the method 300 may proceed to block 334, and the method 300 may proceed to block 326 in response to a determination that the ambient temperature is greater than the threshold value. Additionally, in some embodiments, one or more expansion valves 120 may be controlled to achieve another desired set point for another operating parameter. For example, instead of controlling the expansion valves 120 to achieve a suction superheat set point and/or discharge superheat set point, the controller 220 may control the expansion valves 120 to achieve a suction temperature set point and/or discharge temperature set point. Furthermore, instead of controlling the expansion devices 120 to achieve a suction superheat set point of the compressor 130, the controller 220 may control the expansion devices 120 to achieve an evaporator (e.g., first heat exchanger 104, second heat exchanger 106) outlet superheat set point. Moreover, it should be appreciated that the controller 220 may not be configured to execute the second control sequence 320 of the method 300 in embodiments of the HVAC system 100 that are configured as an air conditioner (e.g., with a furnace) instead of as the heat pump 102.

Returning to block 318, if a demand for cooling exists, the method 300 proceeds to a third control sequence 344 of the method 300. In other words, the second control sequence 344 may be executed in a cooling mode of the heat pump 102 or a cooling mode of the HVAC system 100 configured as an air conditioner. The third control sequence 344 begins with block 346. At block 346, the second expansion device 124 (e.g., outdoor EEV) is adjusted to a fully open position. In this way, working fluid discharged by the second heat exchanger 106 in the cooling mode of the heat pump 102 or HVAC system 100 may flow through the second expansion device 124 without throttling. In other words, the working fluid discharged from the second heat exchanger 106 may flow along the third conduit portion 182 (e.g., to the economizer 180, to the injection conduit 200, to the first expansion device 122) in a liquid phase.

The method 300 may then proceed to block 348. At block 348, an operating parameter of the heat pump 102 is compared to a threshold value to determine whether the operating parameter is greater than the threshold value. In the illustrated embodiment, the operating parameter is a pressure ratio of the compressor 130 and/or heat pump 102. The operating parameter and/or corresponding threshold value may be the same as or different from that of block 324. As similarly discussed above, in other embodiments, another operating parameter of the heat pump 102 (e.g., ambient temperature) may be compared to a corresponding threshold value. To execute the step at block 348, the controller 220 may be configured to receive data and/or feedback from one or more sensors 230 of the heat pump 102, such as working fluid pressure sensors (e.g., suction pressure sensor, discharge pressure sensor), an ambient temperature sensor, or other suitable sensor.

In response to a determination that a pressure ratio of the compressor 130 and/or heat pump 102 is not greater than a threshold value (e.g., 2.3, 2.5, 2.7), the method 300 may proceed to block 350. At block 350, the third expansion device 202 disposed along the injection conduit 200 is adjusted to a fully closed position. Thus, working fluid may not flow along the injection conduit 200, and working fluid may not be injected into the compressor 130 via the injection port 140. From block 350, the method 300 proceeds to block 352, whereby a speed of the compressor 130 is compared to a threshold value, which may be the same or different as the threshold value described above with reference to blocks 328 and 334. Based on a determination that the speed of the compressor 130 is not greater than the threshold value, the method 300 may proceed to block 354. At block 354, the first expansion device 122 (e.g., indoor EEV) is controlled to adjust suction superheat of the heat pump 102. For example, the controller 220 may control, adjust, or otherwise operate the first expansion device 122 to adjust the suction superheat of the heat pump 102 toward a target suction superheat set point. To this end, one or more values of the target suction superheat set point may be stored in the memory device 224 of the controller 220, and/or the controller 220 may receive feedback from one or more of the sensors 230 (e.g., temperature and/or pressure sensors disposed along the suction conduit 132) to determine whether adjustment of the first expansion device 122 is desired to achieve the suction superheat set point.

Based on a determination that the speed of the compressor 130 is greater than the threshold value at block 352, the method 300 may proceed to block 356. At block 356, the first expansion device 122 (e.g., indoor EEV) is controlled to adjust discharge superheat of the heat pump 102. For example, the controller 220 may control, adjust, or otherwise operate the first expansion device 122 to adjust the discharge superheat of the heat pump 102 toward a target discharge superheat set point. One or more values of the target discharge superheat set point may be stored in the memory device 224 of the controller 220, and/or the controller 220 may receive feedback from one or more of the sensors 230 (e.g., temperature and/or pressure sensors disposed along the discharge conduit 136) to determine whether adjustment of the first expansion device 122 is desired to achieve the discharge superheat set point. As will be appreciated, control of the second expansion device 124 to achieve a discharge superheat set point in the cooling mode may cause the first heat exchanger 104 to partially (i.e., not fully) evaporate the working fluid, such that an amount of liquid working fluid enters the compressor 130. As the compressor 130 may be a high-side shell compressor, the compressor 130 may be configured to receive some liquid working fluid at the suction port 132. In this operating condition, the suction pressure may increase, which may reduce power consumption of the compressor 130. The density of working fluid within the compressor 130 may also increase, which increases the mass flow of working fluid through the compressor 130 and thereby increases the capacity of the heat pump 102.

Returning to block 348, in response to a determination that a pressure ratio of the compressor 130 and/or heat pump 102 is greater than a threshold value, the method 300 may proceed to block 358. At block 358, a speed of the compressor 130 is compared to a threshold value (e.g., threshold speed value, threshold speed, 2300 RPM, 2400 RPM, 2500 RPM), which may be the same or different as the threshold value discussed above with reference to blocks 328, 334, and/or 352. Based on a determination that the speed of the compressor 130 is not greater than the threshold value, the method 300 may proceed to block 360. At block 360, the third expansion device 202 disposed along the injection conduit 200 is adjusted to a fully closed position. Thus, working fluid may not flow along the injection conduit 200, and working fluid may not be injected into the compressor 130 via the injection port 140. The method 300 then continues to block 362, whereby the first expansion device 122 (e.g., indoor EEV) is controlled to adjust suction superheat of the heat pump 102, as similarly described above with reference to block 354.

Based on a determination that the speed of the compressor 130 is greater than the threshold value at block 358, the method 300 may proceed to block 364. At block 364, the third expansion device 202 (e.g., injection EEV) is controlled to adjust discharge superheat of the heat pump 102. For example, the controller 220 may control, adjust, or otherwise operate the third expansion device 202 to adjust flow of working fluid injected into the compressor 130 via the injection port 140 and thereby adjust the discharge superheat of the heat pump 102 toward a target discharge superheat set point. Thus, the mass flow rate of working fluid through the compressor 130 is increased, which decreases power consumption of the compressor 130. Additionally, at block 366, the controller 220 may control or adjust the first expansion device 122 to adjust the suction superheat of the heat pump 102 toward a target suction superheat set point (e.g., a positive superheat value), as similarly described above with reference to blocks 354 and 362. In this way, vapor working fluid may be directed to the suction port 132. While the mass flow rate of working fluid to the second heat exchanger 106 may also be increased, embodiments of the heat pump 102 including the economizer 180 may be configured to utilize a portion of the working fluid discharged from the second heat exchanger 106 (e.g., in high ambient conditions, via the injection conduit 200) to provide cooler working fluid to the first heat exchanger 104 in the cooling mode and improve the efficiency of the heat pump 102 in the cooling mode.

As mentioned above, another operating parameter may be evaluated at block 348 (e.g., instead of pressure ratio) in the cooling mode of the heat pump 102. For example, an ambient temperature may be compared to a threshold value. In such embodiments, in response to a determination that the ambient temperature is less than the threshold value (e.g., 90 degrees Fahrenheit), the method 300 may proceed to block 350, and the method 300 may proceed to block 358 in response to a determination that the ambient temperature is greater than the threshold value. Additionally, in some embodiments, one or more expansion valves 120 may be controlled to achieve another desired set point for another operating parameter. For example, instead of controlling the expansion valves 120 to achieve a suction superheat set point and/or discharge superheat set point, the controller 220 may control the expansion valves 120 to achieve a suction temperature set point and/or discharge temperature set point. Furthermore, instead of controlling the expansion devices 120 to achieve a compressor suction superheat set point, the controller 220 may control the expansion devices 120 to achieve an evaporator (e.g., first heat exchanger 104, second heat exchanger 106) outlet superheat set point.

It should be appreciated that certain steps of the method 300 may be performed iteratively throughout an operating cycle of the heat pump 102. For example, in the heating mode, the steps of the second control sequence 320 may be performed iteratively (e.g., based on updated data or feedback received from one or more sensors 230), such that the controller 220 may execute some or all blocks of the second control sequence 320. Similarly, in the cooling mode, the steps of the third control sequence 344 may be performed iteratively (e.g., based on updated data or feedback received from one or more sensors 230), such that the controller 220 may execute some or all blocks of the third control sequence 344. In such embodiments, transition from different portions of the second and third control sequences 320, 344 may be regulated via reference to additional threshold values (e.g., at blocks 324, 328, 334, 348, 352, and/or 358), such as cut-in or cut-out threshold values to avoid repetitive, excessive, or otherwise undesirable transition between different operating modes and/or control sequences of the method 300.

As set forth above, embodiments of the present disclosure may provide one or more technical effects useful for enabling operation of a heat pump system in both a cooling mode and a heating mode, such as in cold climate conditions. Indeed, implementation of the disclosed heat pump system with the control schemes and sequences described herein enable more efficient operation of an HVAC system during cooling and heating operations across a wider range of operating conditions. As a result, the present techniques enable utilization of heat pumps (e.g., without auxiliary heating systems, such as furnaces) to satisfy greater demands (e.g., heating demands) with reduced energy consumption and reduced greenhouse gas emissions. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An energy efficient heat pump for a heating, ventilation, and air conditioning (HVAC) system, comprising:

a working fluid circuit;

a first conduit of the working fluid circuit, wherein the first conduit extends between a first heat exchanger and a second heat exchanger of the working fluid circuit, and wherein the first conduit comprises a first expansion device and a second expansion device;

a compressor disposed along the working fluid circuit, wherein the compressor is configured to direct a working fluid along the working fluid circuit, and the compressor comprises a suction port and an injection port;

an injection conduit extending from the first conduit to the injection port of the compressor, wherein the injection conduit comprises a third expansion device, and the injection conduit is configured to direct a portion of the working fluid from the working fluid circuit, through the third expansion device, and to the injection port of the compressor to inject the portion of the working fluid into the compressor;

an economizer disposed along the first conduit and disposed along the injection conduit, wherein the economizer is configured to place the portion of the working fluid directed along the injection conduit in a counterflow arrangement with the working fluid directed along the first conduit of the working fluid circuit in a heating mode of the energy efficient heat pump; and a controller communicatively coupled to the first expansion device, the second expansion device, and the third expansion device, wherein the controller is configured to;

determine an operating mode of the energy efficient heat pump;

based on a determination that the operating mode is the heating mode:

control the third expansion device based on a pressure ratio of the compressor, a speed of the compressor, or both; and control the second expansion device based on the speed of the compressor; and based on a determination that the operating mode is a cooling mode:

control the third expansion device based on the pressure ratio of the compressor, the speed of the compressor, or both; and control the first expansion device based on the speed of the compressor.

2. The energy efficient heat pump of claim 1, wherein the third expansion device is disposed along the injection conduit upstream of the economizer relative to a flow direction of the portion of the working fluid circuit through the injection conduit.

3. The energy efficient heat pump of claim 1, wherein the first expansion device is disposed along the first conduit between the first heat exchanger and the economizer, and the second expansion device is disposed along the first conduit between the second heat exchanger and the economizer.

4. The energy efficient heat pump of claim 3, wherein, in the heating mode of the energy efficient heat pump, the controller is configured to:

adjust the first expansion device to a fully open position; and in response to a determination that the pressure ratio of the compressor is equal to or less than a threshold value, adjust the third expansion device to a fully closed position.

5. The energy efficient heat pump of claim 4, wherein, in response to the determination that the pressure ratio of the compressor is equal to or less than the threshold value, the controller is configured to compare the speed of the compressor to a threshold speed and:

in response to a determination that the speed of the compressor is equal to or less than the threshold speed, adjust the second expansion device based on a suction superheat of the compressor; and in response to a determination that the speed of the compressor is greater than the threshold speed, adjust the second expansion device based on a discharge superheat of the compressor.

6. The energy efficient heat pump of claim 3, wherein, in the heating mode of the energy efficient heat pump, the controller is configured to:

adjust the first expansion device to a fully open position; and in response to a determination that the pressure ratio of the compressor is greater than a threshold value, compare the speed of the compressor to a threshold speed.

7. The energy efficient heat pump of claim 6, wherein, in response to a determination that the speed of the compressor is equal to or less than the threshold speed, the controller is configured to:

adjust the third expansion device to a fully closed position; and adjust the second expansion device based on a suction superheat of the compressor.

8. The energy efficient heat pump of claim 6, wherein, in response to a determination that the speed of the compressor is greater than the threshold speed, the controller is configured to:

adjust the third expansion device based on a discharge superheat of the compressor; and adjust the second expansion device based on a suction superheat of the compressor.

9. The energy efficient heat pump of claim 3, wherein, in the cooling mode of the energy efficient heat pump, the controller is configured to:

adjust the second expansion device to a fully open position; and in response to a determination that the pressure ratio of the compressor is equal to or less than a threshold value, adjust the third expansion device to a fully closed position.

10. The energy efficient heat pump of claim 9, wherein, in response to the determination that the pressure ratio of the compressor is equal to or less than the threshold value, the controller is configured to compare the speed of the compressor to a threshold speed and:

in response to a determination that the speed of the compressor is equal to or less than the threshold speed, adjust the first expansion device based on a suction superheat of the compressor; and in response to a determination that the speed of the compressor is greater than the threshold speed, adjust the first expansion device based on a discharge superheat of the compressor.

11. The energy efficient heat pump of claim 3, wherein, in the cooling mode of the energy efficient heat pump, the controller is configured to:

adjust the second expansion device to a fully open position; and in response to a determination that the pressure ratio of the compressor is greater than a threshold value, compare the speed of the compressor to a threshold speed.

12. The energy efficient heat pump of claim 11, wherein the controller is configured to:

in response to a determination that the speed of the compressor is equal to or less than the threshold speed:

adjust the third expansion device to a fully closed position; and adjust the first expansion device based on a suction superheat of the compressor; and in response to a determination that the speed of the compressor is greater than the threshold speed:

adjust the third expansion device based on a discharge superheat of the compressor; and adjust the second expansion device based on the suction superheat of the compressor.

13. The energy efficient heat pump of claim 3, wherein, in the heating mode of the energy efficient heat pump, the controller is configured to:

adjust the first expansion device to a fully open position; and in response to a determination that an ambient temperature is less than a threshold value, the controller is configured to compare the speed of the compressor to a threshold speed and:

in response to a determination that the speed of the compressor is equal to or less than the threshold speed, adjust the third expansion device to a fully closed position and adjust the second expansion device based on a suction superheat of the compressor; and in response to a determination that the speed of the compressor is greater than the threshold speed, adjust the third expansion device based on a discharge superheat of the compressor and adjust the second expansion device based on the suction superheat of the compressor.

14. An energy efficient heat pump, comprising:

a working fluid circuit configured to circulate a working fluid, wherein the working fluid circuit comprises a compressor, a first heat exchanger, a second heat exchanger, a first expansion device, an economizer, and a reversing valve, wherein the reversing valve is configured to adjust a flow direction of the working fluid through the working fluid circuit;

a first conduit of the working fluid circuit, wherein the first conduit extends between the first heat exchanger and the second heat exchanger, the first expansion device and the economizer are disposed along the first conduit, and the first conduit is configured to direct the working fluid between the first heat exchanger and the second heat exchanger and through the economizer;

an injection conduit extending from the first conduit to an injection port of the compressor, wherein the injection conduit comprises a second expansion device, and the injection conduit is configured to direct a portion of the working fluid from the working fluid circuit, through the second expansion device, through the economizer, and to the injection port of the compressor to inject the portion of the working fluid into the compressor; and a controller communicatively coupled to the first expansion device and the second expansion device, wherein the controller is configured to:

receive data indicative of a pressure ratio of the compressor and data indicative of a speed of the compressor;

compare the pressure ratio of the compressor to a threshold pressure ratio value;

compare the speed of the compressor to a threshold speed value;

adjust the second expansion device based on the comparison of the pressure ratio of the compressor to the threshold pressure ratio value, the comparison of the speed of the compressor to the threshold speed value, or both; and adjust the first expansion device based on the comparison of the speed of the compressor to the threshold speed value.

15. The energy efficient heat pump of claim 14, wherein the controller is configured to adjust the position of the second expansion device to a fully closed position in response to a determination that the pressure ratio of the compressor is less than or equal to the threshold pressure ratio value, in response to a determination that the speed of the compressor is less than or equal to the threshold speed value, or both.

16. The energy efficient heat pump of claim 15, wherein the controller is configured to control the first expansion device based on a suction superheat of the compressor in response to the determination that the speed of the compressor is less than or equal to the threshold speed value, in response to a determination that the pressure ratio of the compressor is greater than the threshold pressure ratio value, or both.

17. The energy efficient heat pump of claim 14, comprising a third expansion device, wherein the first expansion device is disposed along the first conduit between the first heat exchanger and the economizer, and the third expansion device is disposed along the first conduit between the second heat exchanger and the economizer.

18. An energy efficient heat pump, comprising:

a working fluid circuit configured to circulate a working fluid, wherein the working fluid circuit comprises a compressor, a first heat exchanger, a second heat exchanger, a first expansion device, a second expansion device, an economizer, and a reversing valve, wherein the reversing valve is configured to adjust a flow direction of the working fluid through the working fluid circuit;

a first conduit of the working fluid circuit, wherein the first conduit extends between the first heat exchanger and the second heat exchanger, the economizer is disposed along the first conduit, the first expansion device is disposed along the first conduit between the first heat exchanger and the economizer, the second expansion device is disposed along the first conduit between the economizer and the second heat exchanger, and the first conduit is configured to direct the working fluid between the first heat exchanger and the second heat exchanger and through the economizer; and an injection conduit extending from the first conduit to an injection port of the compressor, wherein the injection conduit comprises a third expansion device, and the economizer is disposed along the injection conduit; and a controller configured to:

determine an operating mode of the energy efficient heat pump;

receive first data indicative of a pressure ratio of the compressor;

receive second data indicative of a speed of the compressor;

in response to a determination that the operating mode is a heating mode:

adjust the first expansion device to a fully open position;

control the second expansion device based on a comparison of the speed of the compressor to a threshold speed value; and control the third expansion device based on a comparison of the pressure ratio of the compressor to a pressure ratio threshold value, the comparison of the speed of the compressor to the threshold speed value, or both; and in response to a determination that the operating mode is a cooling mode:

adjust the second expansion device to a fully open position;

control the first expansion device based on the comparison of the speed of the compressor to the threshold speed value; and control the third expansion device based on the comparison of the pressure ratio of the compressor to the pressure ratio threshold value, the comparison of the speed of the compressor to the threshold speed value, or both.

* * * * *